US007274302B2

(12) United States Patent
Stevenson et al.

(10) Patent No.: US 7,274,302 B2
(45) Date of Patent: Sep. 25, 2007

(54) LIGHT EMITTING DIODE TRAFFIC CONTROL DEVICE

(75) Inventors: Bob Stevenson, Richardson, TX (US); Paul Calixto, Arlington, TX (US); Henry Lee, Carrollton, TX (US); Edson Calixto, Plano, TX (US); Jorge Santana, Frisco, TX (US); Ralph Ferguson, Van Nuys, CA (US)

(73) Assignee: USA Signal Technology, LLC, Addison, TX (US)

( * ) Notice: Subject to any disclaimer, the term of this patent is extended or adjusted under 35 U.S.C. 154(b) by 57 days.

(21) Appl. No.: 10/843,876

(22) Filed: May 12, 2004
(Under 37 CFR 1.47)

(65) Prior Publication Data

US 2005/0122229 A1 Jun. 9, 2005

Related U.S. Application Data

(60) Provisional application No. 60/485,196, filed on Jul. 7, 2003, provisional application No. 60/485,163, filed on Jul. 3, 2003, provisional application No. 60/469,747, filed on May 12, 2003, provisional application No. 60/469,730, filed on May 12, 2003.

(51) Int. Cl.
*G08B 5/22* (2006.01)

(52) U.S. Cl. ..... 340/815.45; 362/294; 362/373; 361/688; 361/690

(58) Field of Classification Search ..... 340/815.45; 362/294, 373; 361/688–690
See application file for complete search history.

(56) References Cited

U.S. PATENT DOCUMENTS

| | | | | |
|---|---|---|---|---|
| 5,898,381 | A * | 4/1999 | Gartner et al. | 340/815.65 |
| 6,054,932 | A * | 4/2000 | Gartner et al. | 340/815.65 |
| 6,236,331 | B1 * | 5/2001 | Dussureault | 340/815.45 |
| 6,244,727 | B1 * | 6/2001 | Ryan et al. | 362/244 |
| 6,803,732 | B2 * | 10/2004 | Kraus et al. | 315/307 |
| 2002/0175826 | A1 * | 11/2002 | Hutchison et al. | 340/815.45 |

* cited by examiner

*Primary Examiner*—Daniel Wu
*Assistant Examiner*—Travis R. Hunnings

(57) ABSTRACT

A convection cooled traffic control device for selectively indicating traffic control guidance to vehicles. An enhanced brightness traffic control device for selectively displaying patterns of light emitting diodes (LEDs). A convection cooled traffic control device for selectively directing traffic by selectively actuating patterns of LEDs. A tapering system of a LED traffic control device. A brightness regulated LED traffic signal lamp. A conflict monitor interface system for a LED signal lamp. A failure logging method for compiling LED failures within an LED traffic signal light.

26 Claims, 33 Drawing Sheets
(22 of 33 Drawing Sheet(s) Filed in Color)

[Bottom View]

[Top View]

[Top View]

[Side View]

[Bottom View]

| Item | Qty | Description | Specification |
|---|---|---|---|
| 17 | 1 | Polycarbonate Base, 12" Bulb | USA-14-100-11000 |
| 16 | 1 | VHB Tape - Base To P.S. PCBA, 12" Bulb | USA-13-100-11107 |
| 15 | 1 | Green Power Supply PCBA, 12" Bulb | USA-01-120-12040-A |
| 14 | 1 | Power Supply PCBA Heat Sink, 12" Bulb | USA-10-100-11001-D |
| 13 | 1 | VHB Tape - Base To Conv. Cooling, 12" Bulb | USA-13-100-11106 |
| 12 | 1 | VHB Tape - P.S. HS To Conv. Cooling, 12" Bulb | USA-13-100-11105 |
| 11 | 1 | Convection Cooling Ring, 12" Bulb | USA-10-100-11140 |
| 10 | 1 | VHB Tape - C. Cooling To Heat Sink Base, 12" Bulb | USA-13-100-11104 |
| 9 | 1 | Heat Sink Base, LED PCBA, 12" Bulb | USA-10-100-11130-D |
| 8 | 1 | Heat Sink W/ LED Array Holes, 12" Bulb | USA-10-100-11120-D |
| 7 | A/R | Thermal Compound | USA-13-000-1641 |
| 6 | 1 | Green PCBA, 12" Bulb | USA-01-120-12090-A |
| 5 | 1 | VHB Tape - C. Cooling To Reflec. (Inner), 12" Bulb | USA-13-100-11103 |
| 4 | 1 | VHB Tape - C. Cooling To Reflec. (Outer), 12" Bulb | USA-13-100-11102 |
| 3 | 1 | Reflector, 12" Bulb | USA-14-100-11001 |
| 2 | 1 | VHB Tape - Reflector To Lens, 12" Bulb | USA-13-100-11101 |
| 1 | 1 | Polycarbonate Lens, UV Hard, 12" Bulb | USA-14-100-01001 |

FIG. 46

LIGHT EMITTING DIODE TRAFFIC CONTROL DEVICE

Any reference cited hereafter are incoroporated by reference to the maximun extent allowable by law. To the extent a reference may not be fully incorporated herein, it is incorporated by reference for background purpose and indicative of the knowledge of one of ordinary skill in the art.

CROSS-REFERENCE TO RELATED PATENT APPLICATIONS

This patent application claims the benefit of:

U.S. Provisional Patent Application No. 60/469,747, filed May 12, 2003, entitled "Light Emitting Diode Signal Lamp";

U.S. Provisional Patent Application No. 60/469,730, filed May 12, 2003, entitled "Light Emitting Diode Signal Lamp";

U.S. Provisional Patent Application No. 60/485,163, filed Jul. 3, 2003, entitled "Light Emitting Diode Signal Lamp"; and U.S. Provisional Patent Application No. 60/485,196, filed Jul. 7, 2003, entitled "Light Emitting Diode Signal Lamp".

TECHNICAL FIELD OF THE DISCLOSURE

The present invention relates generally to the field of traffic control devices. More particularly, it concerns a light emitting diode traffic control device.

BACKGROUND OF THE DISCLOSURE

Traffic control devices, such as signal lamps, play a major role in enabling the existence of modern traffic systems. As such, they also account for high costs to metropolitan and other political jurisdictions that must procure, install, maintain, and replace such signal lamps.

Insufficient light output, flexibility in accepting various power sources, overheating, and susceptibility to damage or degradation due to short- or long-term subjection to transient power surges are just some of the issues that have been persistent problems in the field of signal lamps.

Traffic control devices, such as left turn signals and other traffic signs, serve the well-known function of directing traffic. To be effective, such signs must be easily visible from significant distances. However, one drawback of conventional traffic signs is that they have a permanent and unchanging nature. For example, the only way that a conventional "no right turn" traffic sign can prohibit right turns during the hours of 7:00 AM and 7:00 PM is to have that qualification inscribed on the sign itself.

Inscribing such qualifications is fraught with two great limitations. First, a traffic sign typically has a severely limited area within which to inscribe such a qualification. Moreover, in order to be effective, the inscribed qualification must be easily visible from significant distances. Therefore, the inscribed qualification must be typeset using large letters, which even further limits potential content.

Second, the inscribed qualification is typically affixed to the sign in a relatively permanent manner. Consequently, the inscribed qualification cannot be easily changed on frequent basis.

Some attempts to solve this problem have been made by implementing light based signs. Such a sign can be switched on during active time periods, and otherwise switched off. However, such signs have encountered numerous problems, such as overheating, insufficient visibility, over-brightness in darkness, and unreliability.

Thus, what is needed is a traffic sign that can overcome those and other problems while proving traffic control during selected time periods without resorting to inscribing of qualifications.

Light emitting diode signal lamps produce light output using light emitting diodes. Such diodes are traditionally organized in an array. FIG. 30 schematically shows a side view of a signal lamp that includes light emitting diodes (LEDs) 12 arranged in a uniformly distributed array. Diffuser 14 is oriented in relation to LEDs 12 so as to cosmetically enhance the appearance of the signal lamp of FIG. 30. The diffuser 14 prevents viewers from clearly seeing individual LEDs and, more importantly, individual LED failures. The signal lamp of FIG. 30 also includes a collector lens 16, which focuses light received from the diffuser in a centering fashion in order to meet requirements of a typical governmental traffic lamp specification. The special lenses required by the signal lamp of FIG. 30 increase its cost, and other problems will also be apparent to those skilled in the art.

Turning to FIG. 31, another signal lamp of the prior art is schematically depicted, including LEDs 18 arranged in a densely configured square-shaped array in the center of the signal lamp. The motivation for configuring LEDs 18 in a dense square-shaped array in the center of the signal lamp is to achieve compliance with a governmental specification that regulates traffic lamps. Fresnel lens 20 is oriented relative to the LEDs 18 in order to cosmetically improve the light output distribution of the signal lamp of FIG. 31 by somewhat spreading light output away from the center of the signal lamp, while leaving the center very bright. However, among the drawbacks of the signal lamp of FIG. 31 is that a special lens is required, thereby increasing cost of the system. Furthermore, the LED signal lamp of FIG. 31 uses a relatively small number of LEDs, and thus could be subject to a corresponding reduction in reliability.

A third type of signal lamp of the prior art is shown schematically in FIG. 32. LEDs 22 are arranged in a uniformly distributed array, being adapted to produce undiffused light 24. A diffuser 25 is oriented relative to the LEDs 22 for intercepting and converting at least some of the undiffused light 24 in order to produce diffused light 26. However, the signal lamp of FIG. 32, like those of FIGS. 1 and 2, requires a special lens, thereby increasing cost of the system.

Another problem that commonly occurs in the field of light emitting diode signal lamps is that when one or more light emitting diodes fail, the surviving light emitting diodes suffer accelerated aging as a direct result. FIG. 35 depicts a string of light emitting diode stages, including a first stage 48 and a second stage 50. Each stage includes LEDs 52. When constant voltage is maintained across the string, the failure of one of the LEDs 52 within the first stage 48 will cause the surviving LEDs 52 of the first stage 48 to suffer accelerated degradation due to the correspondingly higher current load they will be forced to carry.

Traffic signal lamps for an intersection are typically connected to a conflict monitor in order to detect the occurrence of conflicting states among traffic signals; for example, all traffic signals green. Upon detection of such a problem, the conflict monitor will cause the lights of the intersection to enter a default "safe state"; for example, one set of opposing lights flashing yellow, the other set of opposing lights flashing red.

The conflict monitor can also send the traffic signals of the intersection into a safe state if all of the traffic signals facing a given direction fail. FIG. 38 shows a prior art schematic representation of an incandescent signal lamp 80 of the prior art connected to a conflict monitor of the prior art 82. Upon failure, incandescent signal lamp 80 no longer passes current, which is detected by the conflict monitor 82. Thus the conflict monitor 82 can engage appropriate logic to manage the signal lamps of the intersection in response to detection of failed signal lamps. FIG. 39 shows conflict monitor 82 connected to a light emitting diode signal lamp 84 of the prior art. A problem of prior art light emitting diode signal lamps is that they pass current even after having failed. As a result, the conflict monitor is not aware of such failures, and is hindered in taking appropriate action in response to failure of light emitting diode signal lamps.

The LEDs used in light emitting diode signal lamps dim with age. Once such LEDs have dimmed to the point that their light output falls below a desired level, they should be replaced. In addition, some will fail before dimming sufficiently to require replacement. Such failures not only have an immediately negative impact on the light output of the signal lamp, they can also result in the above-described accelerated degradation of the surviving LEDs. One response in the industry has been to replace every LED signal lamp after a fixed amount of time, such as 3 years, whether a particular lamp needs to be replaced or not. However, such a blind replacement program does not adequately address signal lamps that fail prior to their scheduled replacement or signal lamps that would have significant useful life beyond their scheduled replacement. In the former event, a dangerous situation could result from failure of an in-service signal lamp. In the latter event, unnecessary costs are directly incurred.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

Reference is now made to the following brief descriptions taken in conjunction with the accompanying drawings, in which like reference numerals indicate like features.

FIG. 46 shows a parts list of the parts called out in FIGS. 27–29, in accordance with an embodiment of the present invention.

DETAILED DESCRIPTION

It will be understood by those skilled in the art that the present invention can be implemented in a number of different ways, within the scope of this application. A presently preferred embodiment of the invention will now be described below.

Overview

Figure 1:
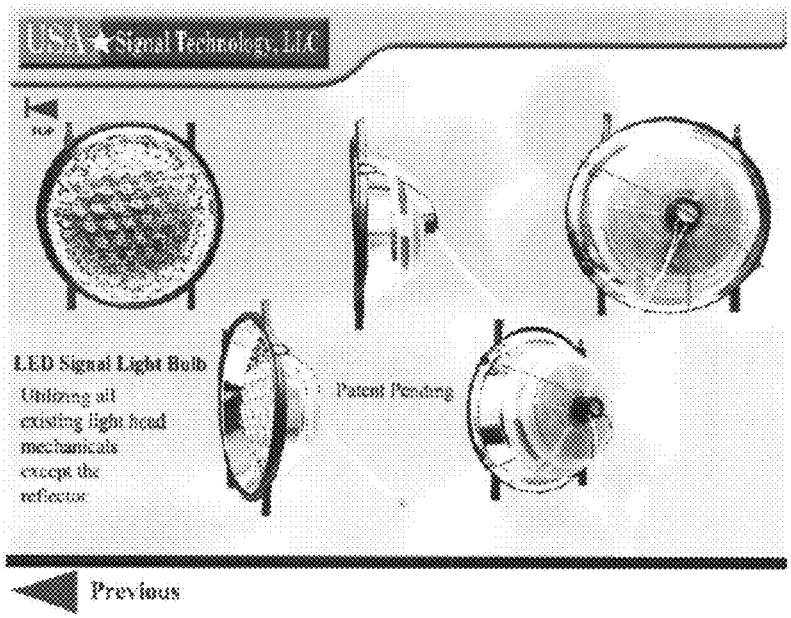
FIG. 1 shows a mostly assembled light emitting diode (LED) signal lamp from several angles, in accordance with an embodiment of the present invention.

FIG. 1 shows a mostly assembled light emitting diode (LED) signal lamp from several angles, in accordance with an embodiment of the present invention. FIG. 1 shows a power supply assembly (having wires extending therefrom), an LED assembly (having a lens cover), and a chimney frame (having obvious apertures) mechanically connecting the two assemblies while leaving a chimney space ventilated between the heat sinks of the power supply assembly and the LED assembly so that the chimney space remains in fluid communication with the environment of the signal lamp. The apertures of the chimney frame can be best seen in the top center signal bulb and the bottom right signal bulb of FIG. 1.

Figure 27:
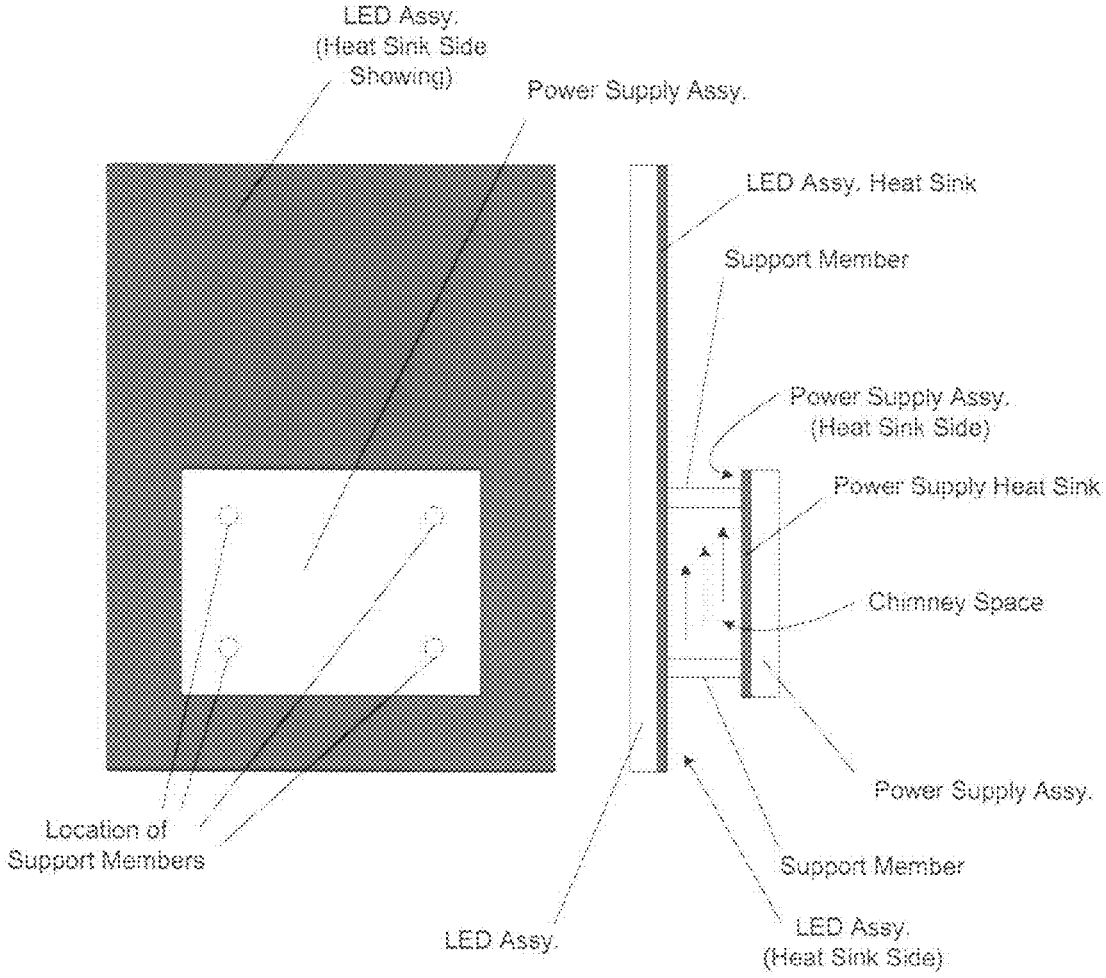
FIG. 27 shows a schematic back view and a side view of a light emitting diode (LED) assembly connected to a power supply assembly, in accordance with an embodiment of the present invention.
Figure 28:
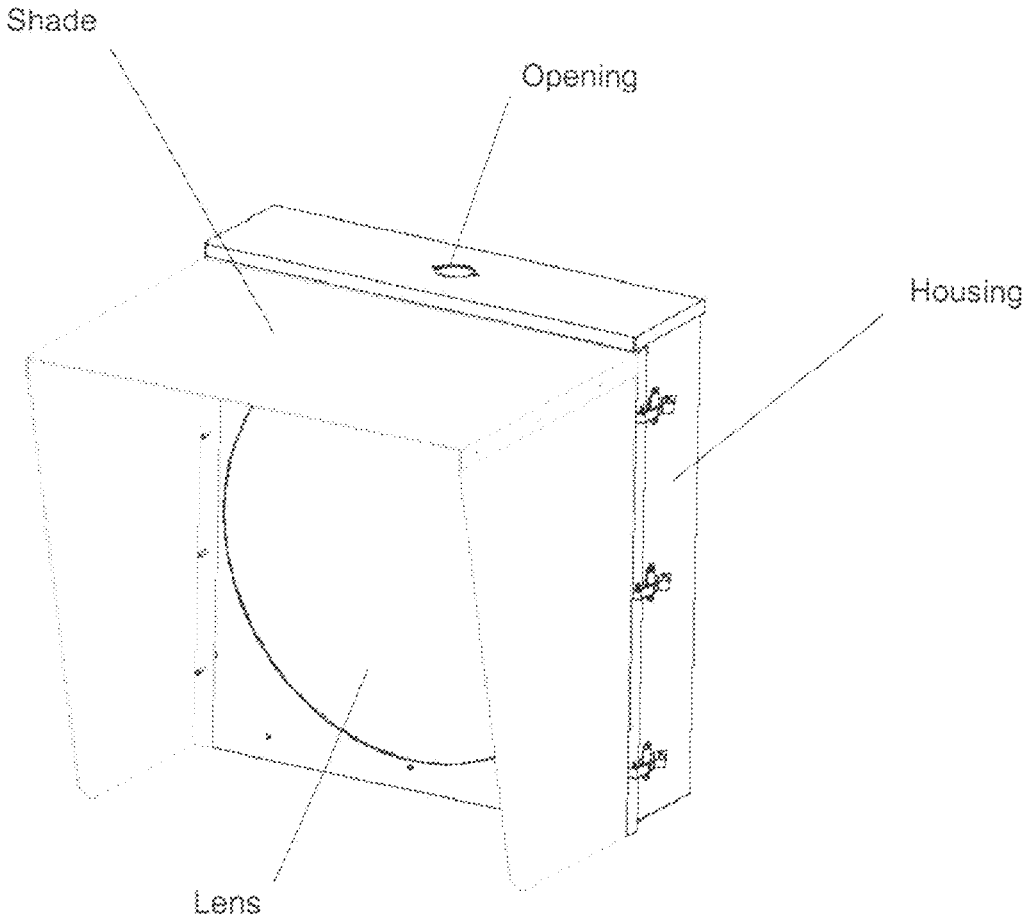
FIG. 28 shows a schematic perspective view of an LED traffic sign, in accordance with an embodiment of the present invention.
Figure 29:
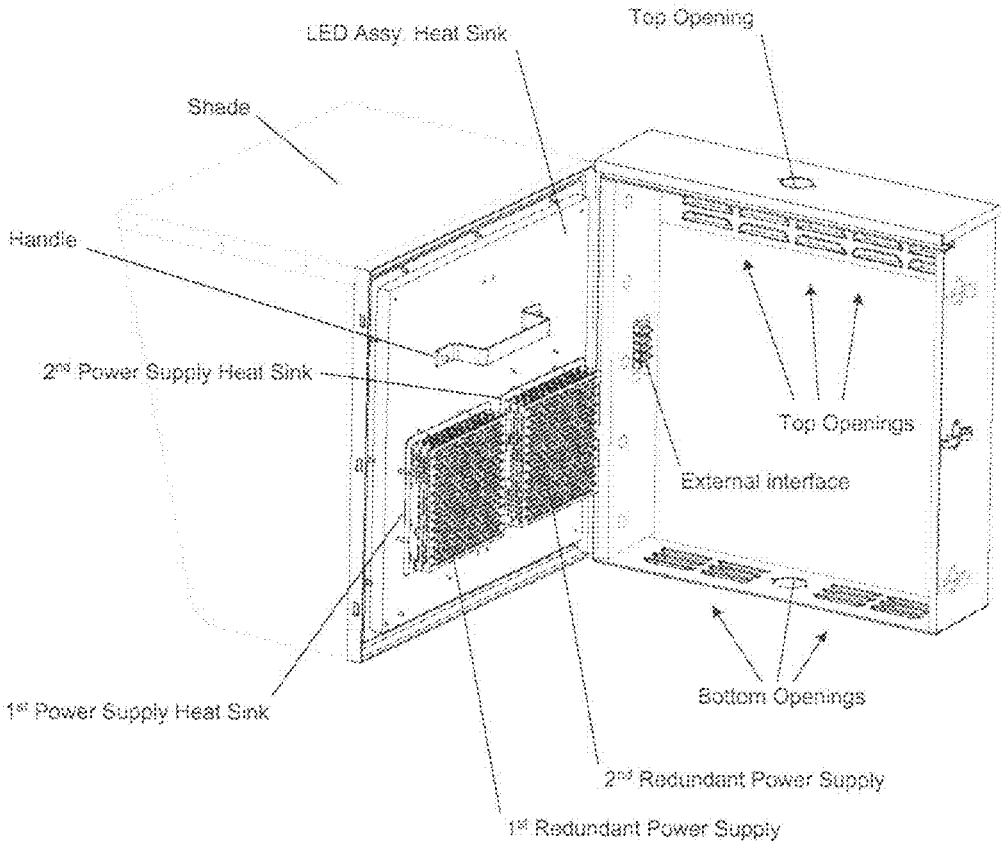
FIG. 29 shows a schematic perspective view of an LED traffic sign opened by approximately 90°, in accordance with an embodiment of the present invention.
Figure 30:
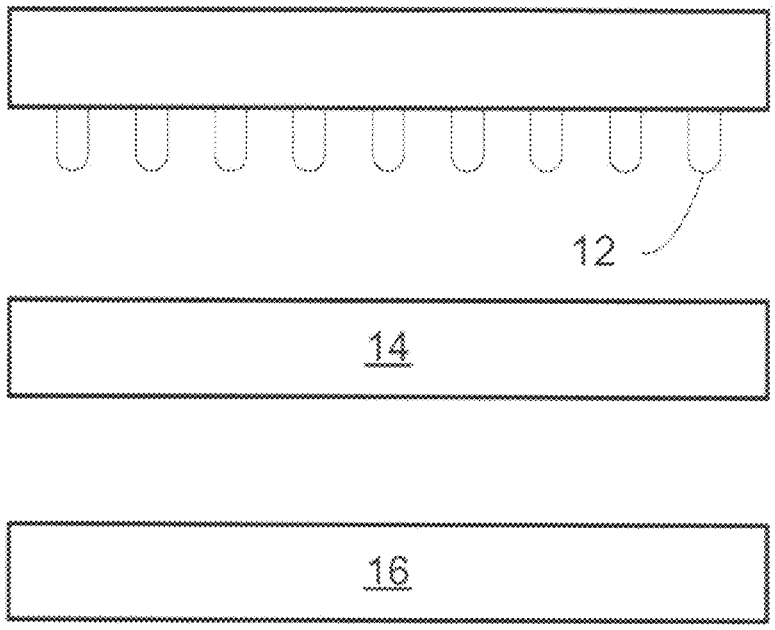
FIG. 30 (PRIOR ART)
FIG. 30 shows a schematic side view of components of a signal lamp of the prior art.

FIGS. 27–29 show a schematic side view of the LED signal lamp, with two regions of connected parts highlighted in order to better show how the illustrated components of the LED signal lamp are connected. The parts shown and called out in FIGS. 27–29 are listed in the parts list of FIG. 30.

Convection Cooling

FIGS. 2–6 and 14–19 show various views related to the convection cooling of the present invention. On embodiment of the present invention includes a power supply/controller assembly, having a heat sink panel on one side; an LED assembly, having a heat sink panel on one side; and a chimney frame that connects the power supply assembly to the LED assembly with the heat sink panels of the assemblies facing each other at a selected distance (thereby creating a chimney space between the heat sinks) configured to create a chimney effect when the power supply and the LED assembly are dissipating heat and the chimney area is substantially vertical. The power supply/controller assembly and the LED assembly are sealed as a single space separate from the environment, but leaving the chimney space in fluid communication with the environment of the LED signal lamp. The "single space" nature of the sealing of the LED assembly and power supply/controller assembly is achieved by virtue of one or more interface openings in the chimney frame.

The chimney effect is improved by the presence of one or more openings toward or at the top of a housing within which the LED signal lamp is housed and one or more openings toward or at the bottom of the housing. Such openings would maintain the interior of the housing (i.e., the immediate fluid environment of the LED signal lamp) in fluid communication with the environment, thereby allowing heated air in the immediate environment of the LED signal lamp to be replaced with cooler air, thereby facilitating the convection cooling effect of the present invention.

Figure 2:
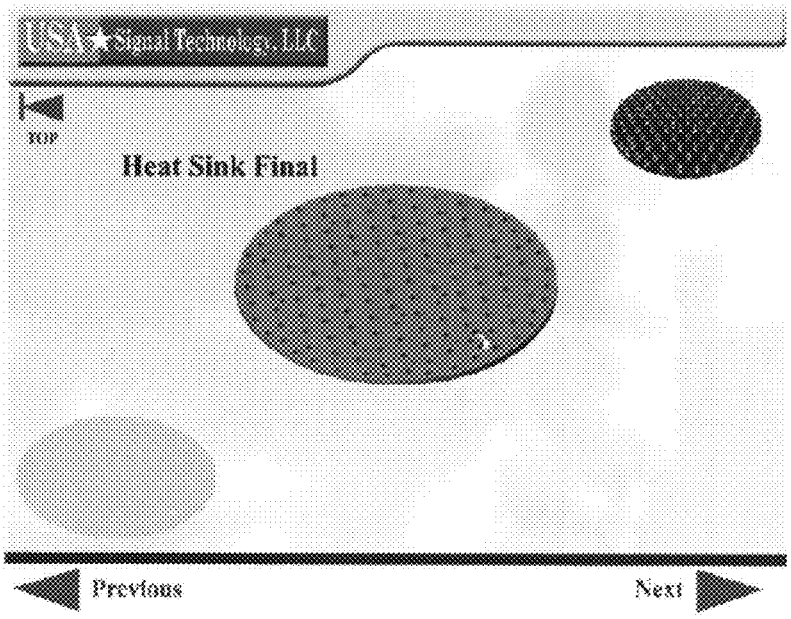
FIG. 2 shows, in the center of the figure, a heat sink with recesses to accommodate LED leads and a (non-circular) hole to accommodate interface between the LED electronics and the power supply electronics; in the lower left corner of the figure, a heat sink covered with a layer of thermal conducting material; in the upper right corner, an LED printed circuit board assembly (PCBA); in accordance with an embodiment of the present invention.

FIG. 2 shows, in the center of the figure, a heat sink with recesses to accommodate LED leads and a (non-circular) hole to accommodate interface between the LED electronics and the power supply electronics; in the lower left corner of the figure, a heat sink covered with a layer of thermal conducting material; in the upper right corner, an LED printed circuit board assembly (PCBA); in accordance with an embodiment of the present invention. In assembling an LED assembly, the LED PCBA will be connected to the center heat sink panel once that panel is also covered in thermal conductive paste.

Figure 3:
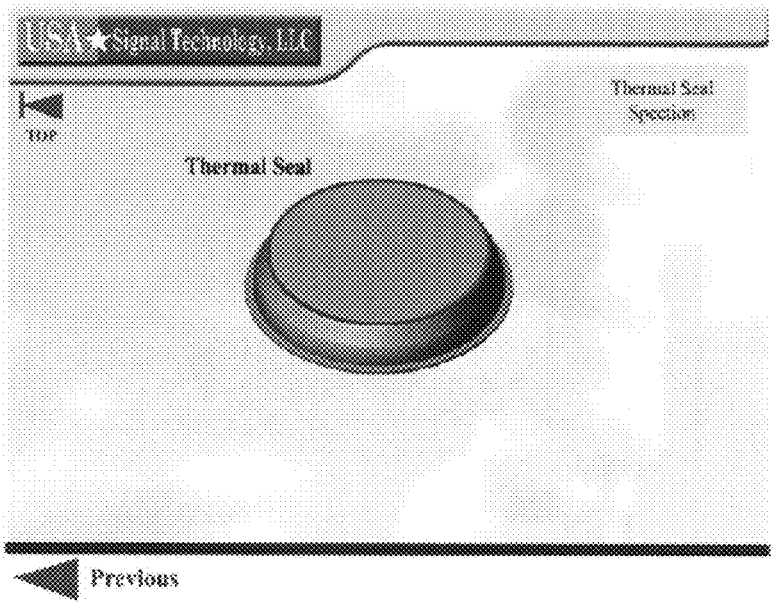
FIG. 3 shows a rear view of the LED heat sink sealed to the reflector array, in accordance with an embodiment of the present invention.

FIG. 3 shows a rear view of the LED assembly with its LED heat sink visible sealed to the reflector array, in accordance with an embodiment of the present invention. Preferably, the seal is a thermal seal that environmentally isolates the LED electronics, except for the opening through which the LED assembly will interface with the power supply assembly. Heat dissipated by the LEDs will be transferred through the heat sink to the heat sink's outer surface (shown in FIG. 3 in the color green and facing the reader).

Figure 4:
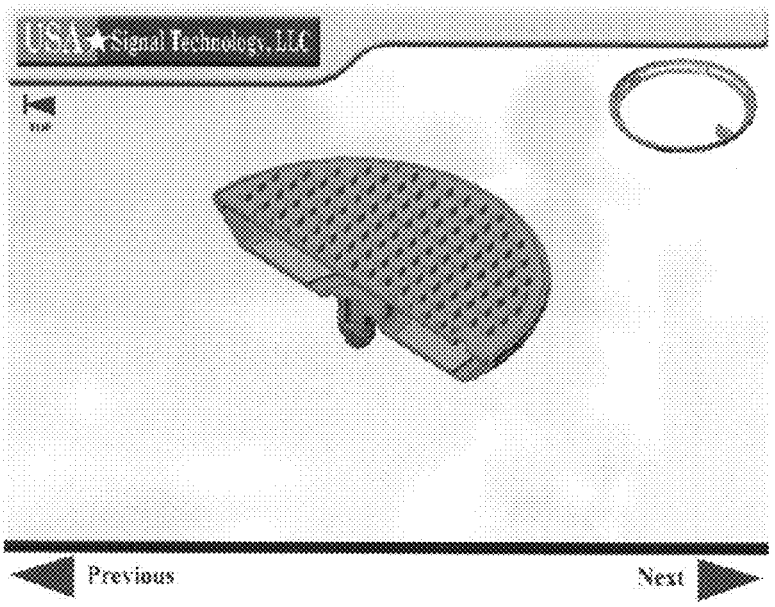
FIG. 4 shows, in the center of the figure, a cross section perspective view of the power supply assembly with its heat sink connected; in the upper right corner of the figure, a chimney frame; in accordance with an embodiment of the present invention.

FIG. 4 shows, in the center of the figure, a cross section perspective view of the power supply assembly with its heat sink connected; in the upper right corner of the figure, a chimney frame; in accordance with an embodiment of the present invention. The heat sink is shown with protruding nodules to improve its ability to dissipate heat.

Figure 5:
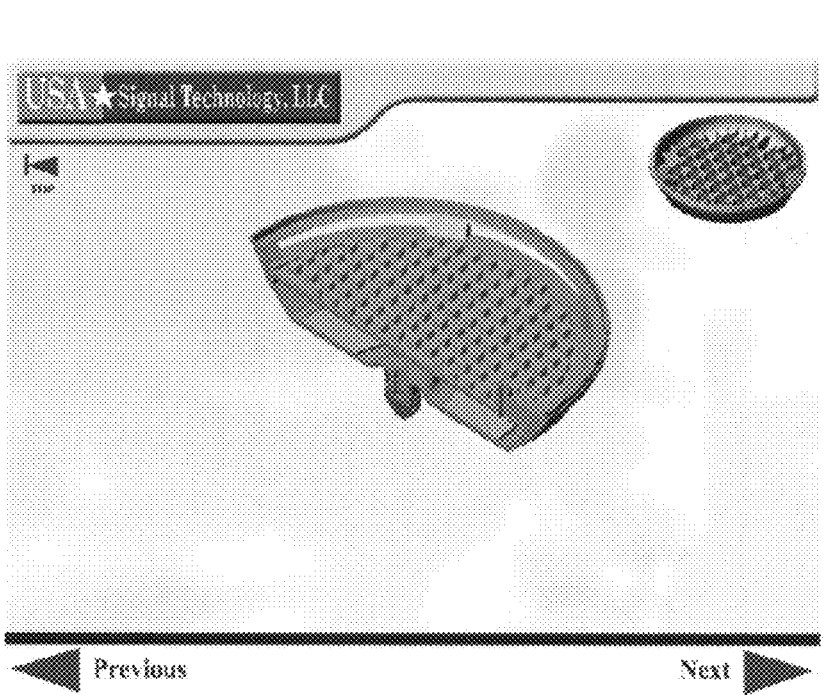
FIG. 5 shows, in the center of the figure, the power assembly supply and heat sink of FIG. 4 with the chimney frame of FIG. 4 connected; in the upper right corner, a reflector array; in accordance with an embodiment of the present invention.

FIG. 5 shows, in the center of the figure, the power assembly supply and heat sink of FIG. 4 with the chimney frame of FIG. 4 connected; in the upper right corner, a reflector array; in accordance with an embodiment of the present invention.

Figure 6:
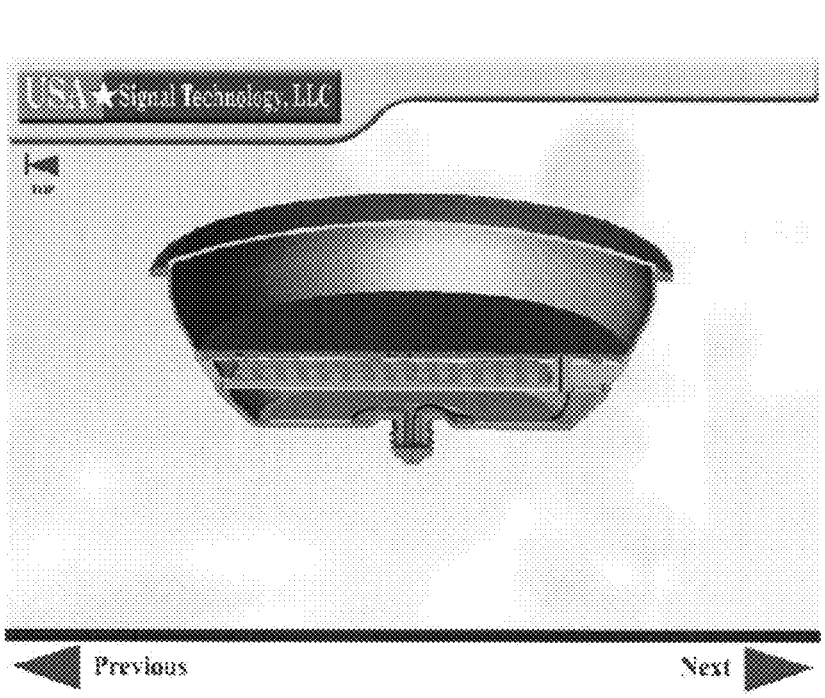
FIG. 6 shows a cross section side view of an assembly of the LED signal lamp, including the power supply with heat sink and chimney frame of FIG. 5 and the outer shell of the reflector array topped with a lens (but not including the LEDs or the reflector array cells), in accordance with an embodiment of the present invention.

FIG. 6 shows a cross section side view of an assembly of the LED signal lamp, including the power supply (shown as mostly cyan) with heat sink and chimney frame of FIG. 5 (mostly pink) and the outer shell of the reflector array (mostly brown) topped with a lens (but not including the LEDs or the reflector array cells), in accordance with an embodiment of the present invention. The chimney frame mechanically connects the power supply assembly and the LED assembly while leaving a chimney space ventilated between the heat sinks of the power supply assembly and the LED assembly.

One advantage that the invention has over the prior art is that this invention allows the LED assembly to be environmentally isolated, while achieving convection-based heat dissipation. In this example, the LED assembly dissipates about 11 Watts, while the power supply/controller assembly dissipates about 6–7 Watts.

Therefore, the LED components (being relatively heat-sensitive) are thermally separated from all other components.

Power Supply

Charge pumps have been used in DC-input/DC-output power supplies to achieve a fixed ratio between input and output voltages. Moreover, their use is typically restricted to low-voltage low-power applications, such as control and logic operation applications. Applications in which such power supplies are useful are limited by virtue of the fixed ratio between input and output voltage.

By contrast, in high-voltage applications involving power greater than 20 Watts, conventional switching power supplies are used. However, such power supplies are typically limited to AC-input/DC-output or DC-input/DC-output. Some such power supplies can accept AC or DC inputs and produce DC output, but these power supplies suffer from slow turn on and turn off times and tend to be much more complex than corresponding power supplies that are limited to AC-input/DC-output or DC-input/DC-output.

Figure 7:
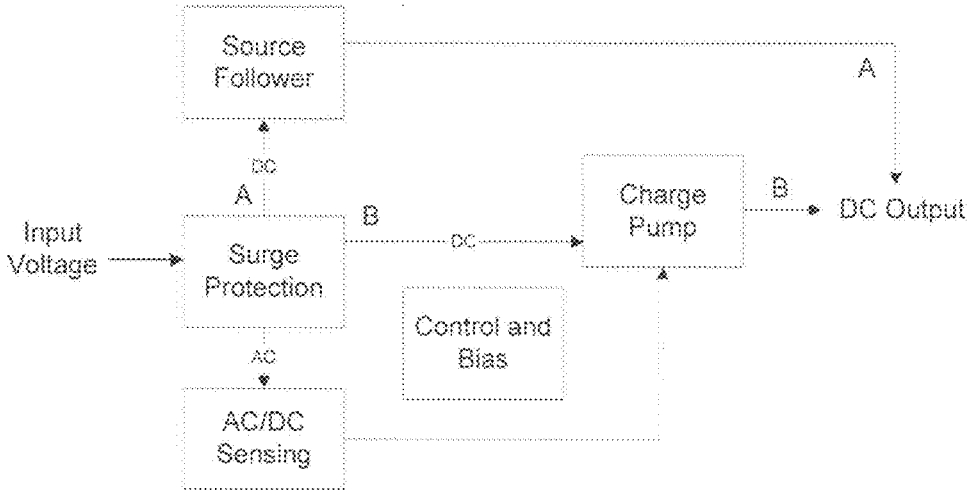
FIG. 7 shows a block diagram of a power supply having a source follower and a charge pump, in accordance with an embodiment of the present invention.

FIG. 7 shows a block diagram of a power supply having a source follower and a charge pump, in accordance with an embodiment of the present invention.

A DC-output power supply having a charge pump as typically encountered in a DC-input/DC-output power supply achieves automatic acceptance of AC input or DC input on an on-going basis. For example, one implementation of the power supply might be constructed so as provide a DC output voltage for any AC or DC input voltage within the range of 30–200 volts (such as, 120 VAC or 48 VDC).

Among the advantages achieved are possible reduction in required area and possibly easier compliance with FCC regulations on the basis of lower EMI. Required are can be reduced by the lack of a requirement to use inductors, and the reduction of EMI is achieved by virtue of using capacitors instead of inductors as the current switch mechanism.

As shown in FIG. 7, input voltage first passes through a surge protector. If the input voltage is AC, it is then converted to DC through a bridge. Consider an application in which the desired DC Output is 130V. If input voltage is between 65V and 130V, then path A is open and path B is operational. In such case, the charge pump operates to achieve DC Output at 130V.

If input voltage is over 130V, then path A is operational and path B is open. In that case, the source follower operates to achieve DC Output at 130V. In the preferred embodiment, the source follower operates as a switch capacitor regulator.

The AC/DC Sensing module is optionally included. For example, if the voltage input were very high frequency AC, then the time period during which the charge pump would be turned on would be so brief as to confer little benefit. In such case, the AC/DC Sensing module can prevent the charge pump from activating.

Figure 8:
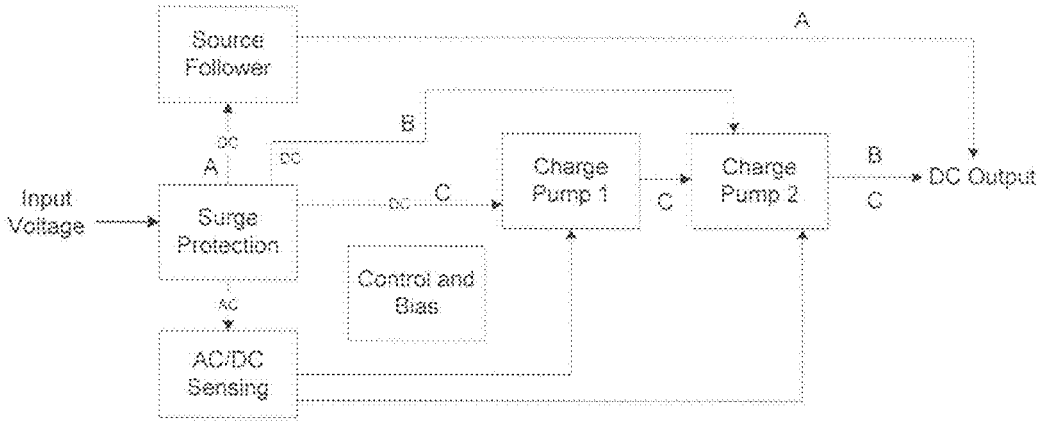
FIG. 8 shows a block diagram of a power supply having a source follower and two charge pumps, in accordance with an embodiment of the present invention.

FIG. 8 shows a block diagram of a DC-output power supply variation using a source follower and two charge pumps according to the present invention in order to extend the ability of the power supply to accept lower input voltages. For example, using the same values as in the preceding example, the power supply can achieve DC Output voltage at 130V for any input voltage of at least 32.5V. Similarly, additional charge pumps can be added to the power supply in order to make the power supply able to accept lower input voltages.

Figure 31:
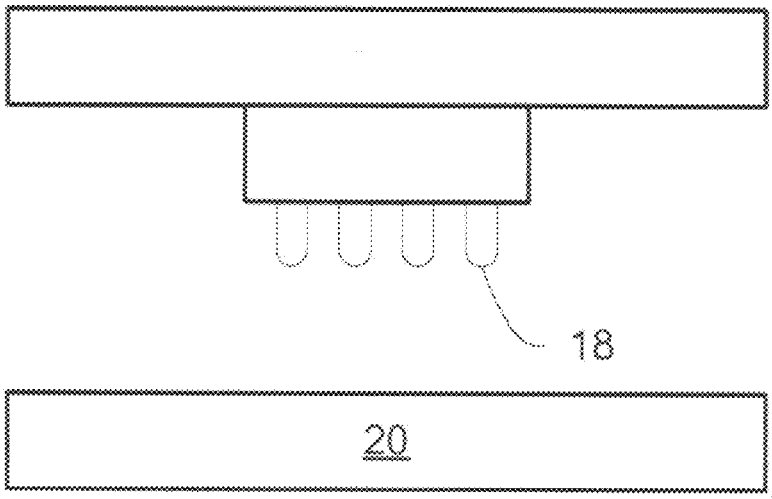
FIG. 31 (PRIOR ART)
FIG. 31 shows a schematic side view of components of a signal lamp of the prior art.
Figure 32:
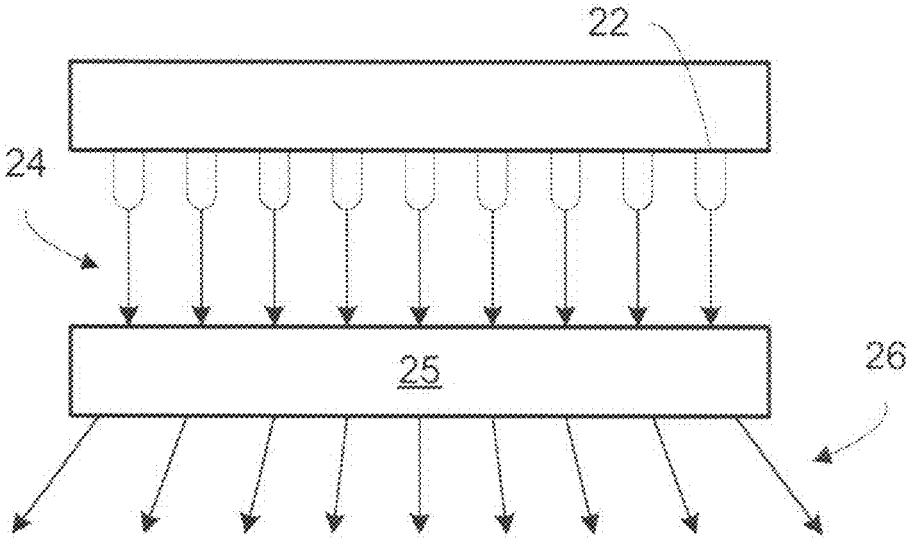
FIG. 32 (PRIOR ART)
FIG. 32 shows a schematic side view of components of a signal lamp of the prior art.

FIG. 31 shows a perspective view of a power supply of one embodiment of the present invention.

Appendix 1 describes a power supply in accordance with the present invention in detail, including fourteen (14) schematic figures labeled "Sheet 1 of 14" through "Sheet 14 of 14."

Appendix 2 describes an alternative embodiment power supply in accordance with the present invention.

Surge Suppressor

A first conventional class of surge suppression methods employs MOVs, gas-discharge tubes, transorbs, and other various devices that clamp high voltage levels and divert current.

A second conventional class of surge suppression methods uses one or more methods of the first class in combination with an inductor to clamp high voltage levels and divert current. A significant drawback to such suppressors is that they tend to fail more frequently than suppressors of the first class.

A surge suppressor system that combines one or more methods of the first conventional class with an inductor tolerant of very high temperature (i.e., having a very high melting point). One such inductor is a nickel chrome wire (or "Ni-chrome" wire). Another possibly suitable material is tungsten.

Figure 9:
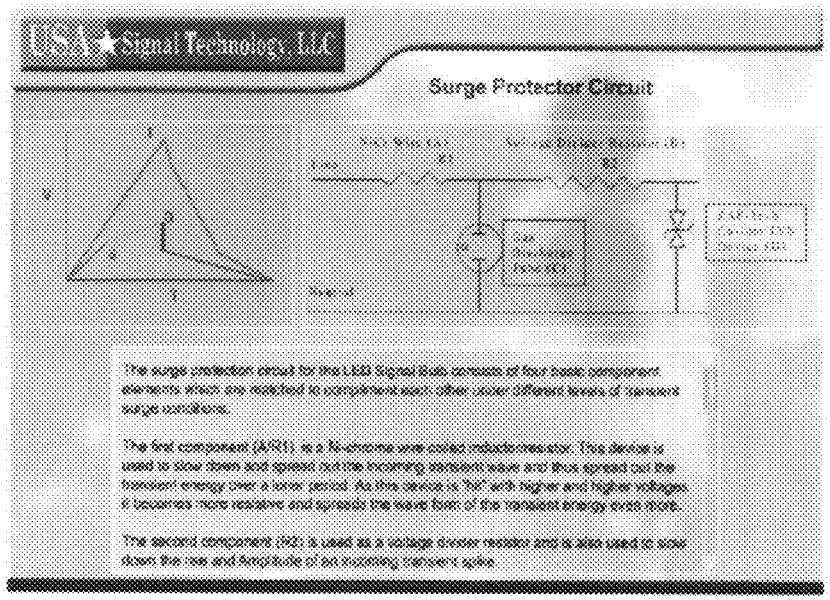
FIG. 9 shows, on the right, a schematic of a surge suppression circuit; on the left, a voltage vs. time graph showing the suppression of a voltage surge; in accordance with an embodiment of the present invention.

FIG. 9 shows, on the right, a schematic of a surge suppression circuit; on the left, a voltage vs. time graph showing the suppression of a voltage surge; in accordance with an embodiment of the present invention.

As shown in FIG. 9, the Ni-chrome wire (A), acting as an inductor, slows down and spreads out incoming voltage waves (alternately, "transient voltage waves"), as indicated by the green voltage line segment, compared to the transient voltage wave, if unprotected, shown as the red voltage. Furthermore, while the Ni-chrome wire remains heated from one voltage wave, it becomes more resistive, thereby having a greater slowing and spreading effect upon a subsequent voltage wave. The Ni-chrome wire (A) is a voltage divider resistor.

The other voltage divider resistor (B) slows the rise and amplitude of an incoming transient voltage spike, as indicated by the yellow voltage line segment.

A fast-acting transient voltage suppressor (Fast TVS) device (D) is used to regulate increasing transient voltage in excess of its breakdown voltage.

A 350V gas discharge tube (C) having excellent high-energy handling capability is utilized to shunt voltage from its side of the voltage divider in order to prevent the Fast TVS device from failing due to having exceeding its maximum rating, as indicated by the black voltage line segment. The magenta line shows discharging of residual energy.

Reflector Array

Figure 10:
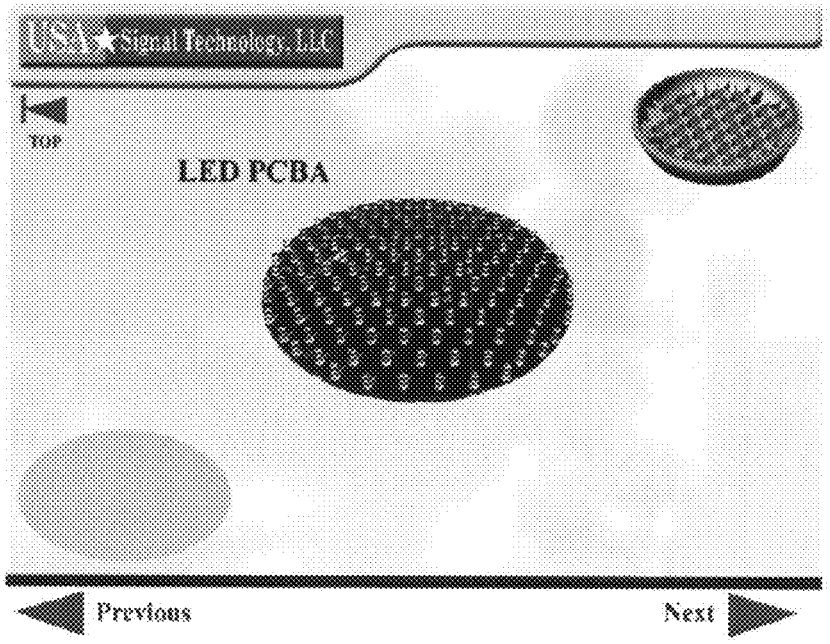
FIG. 10 shows, in the center of the figure, an LED PCBA; in the lower left corner of the figure, a heat sink assembly for the LED PCBA; in the upper right corner, a reflector array; in accordance with an embodiment of the present invention.
Figure 21:
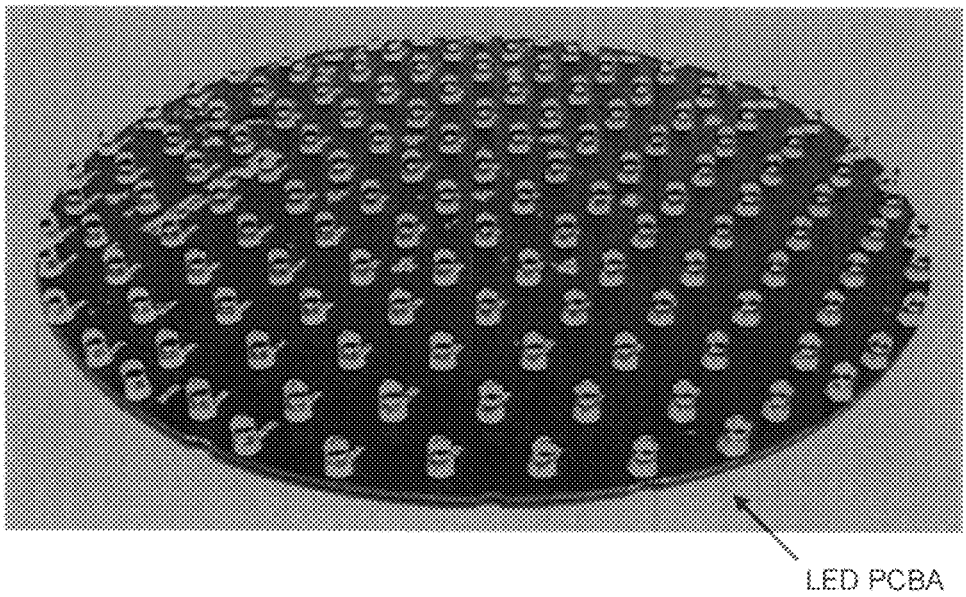
FIG. 21 shows an LED printed circuit board assembly (PCBA), in accordance with an embodiment of the present invention.
Figure 22:
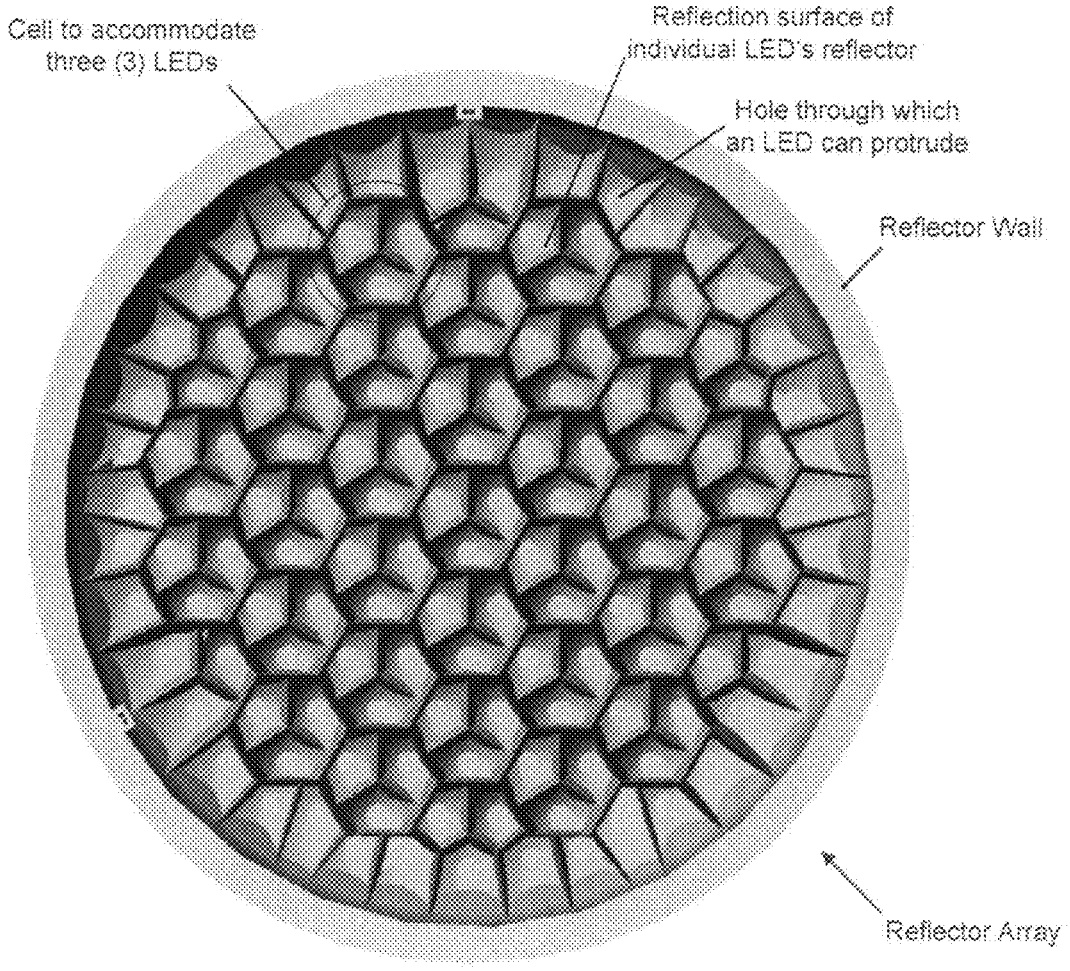
FIGS. 22–26 show a reflector array, in accordance with an embodiment of the present invention.
Figure 23:
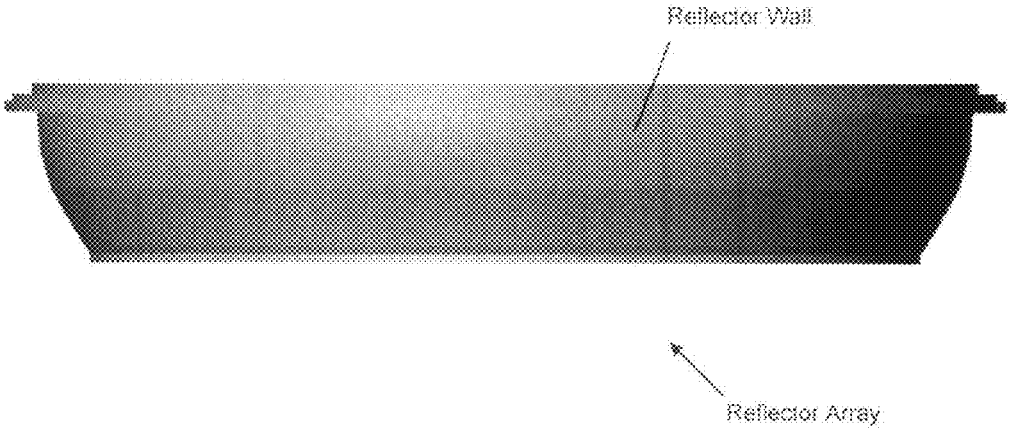
Figure 24:
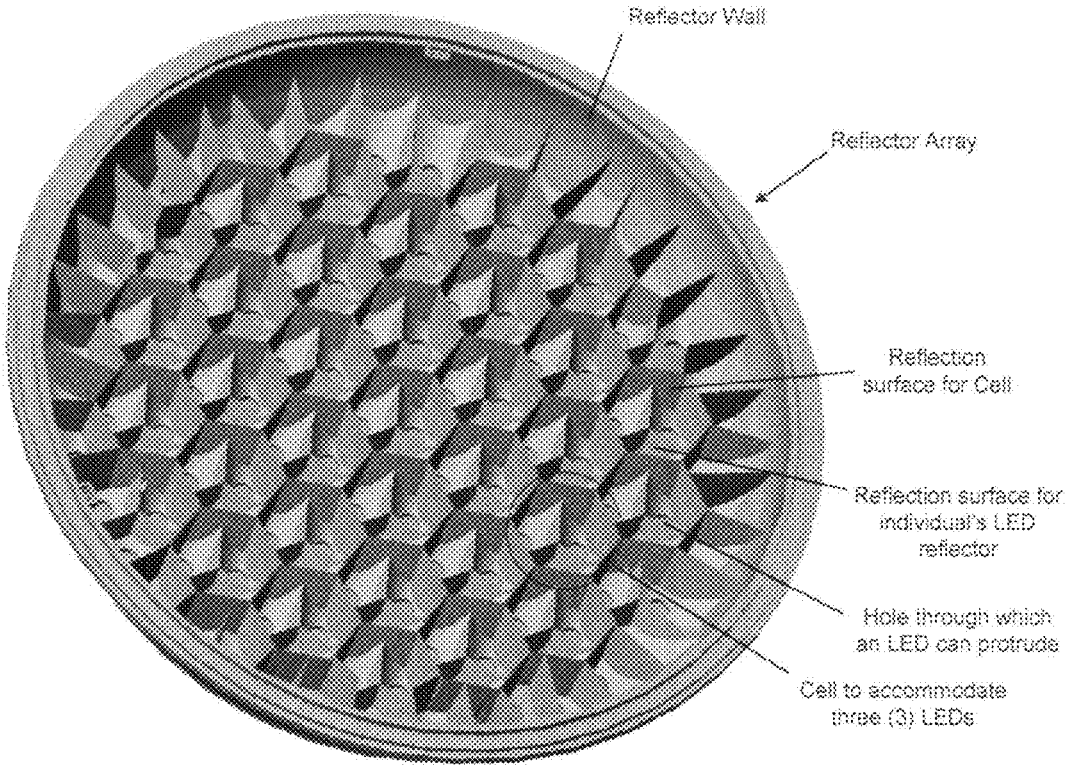
Figure 25:
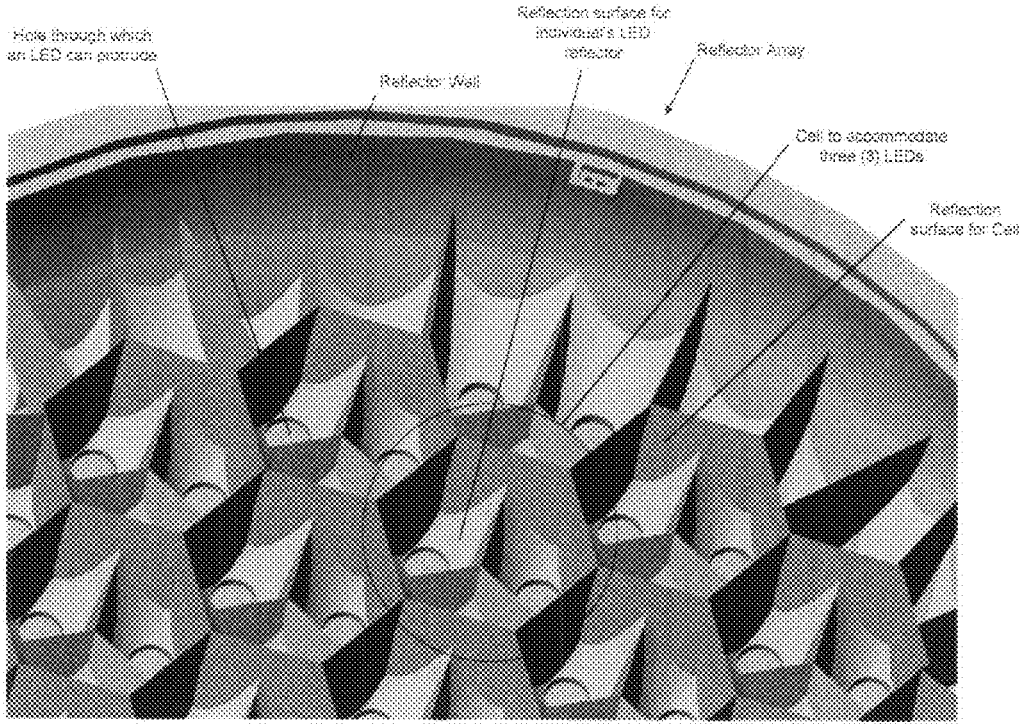
Figure 26:
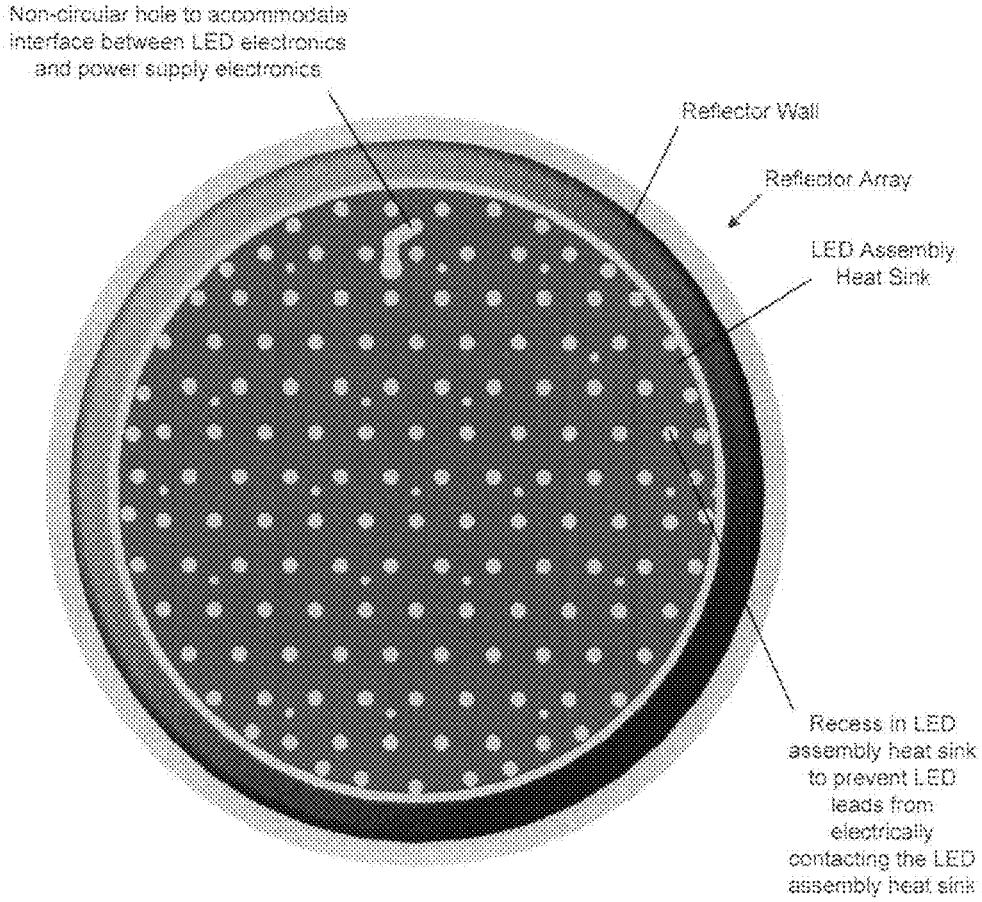

FIG. 10 shows, in the center of the figure, an LED PCBA (better depicted in FIG. 21); in the lower left corner of the figure, a heat sink assembly for the LED PCBA; in the upper right corner, a reflector array; in accordance with an embodiment of the present invention.

An array of reflectors, each configured to increase the usable light output from a set of LEDs, are arranged to achieve a selected aggregate usable light output. Each set of LEDs with corresponding reflector is characterized as a "cell." The preferred embodiment configures each cell to include 3 LEDs, with each cell's reflector being hex-shaped.

A support function achieved by the current implementation is that if one of the LEDs of a cell fails, the other LEDs are automatically brightened to avoid a reduction of usable light output.

In the center of FIG. 10 is depicted an LED PCBA (with LEDs facing toward the reader). In the upper right corner of the figure is a reflector array. In connecting the two components, their relative orientations would remain unchanged—the reflector array would simply be set down onto the LED PCBA. The LEDs would protrude through suitably spaced holes in the reflector array (not shown).

FIGS. 22–26 show a reflector array in accordance with the present invention from varying views and in greater detail.

Optical Feedback

Figure 20:
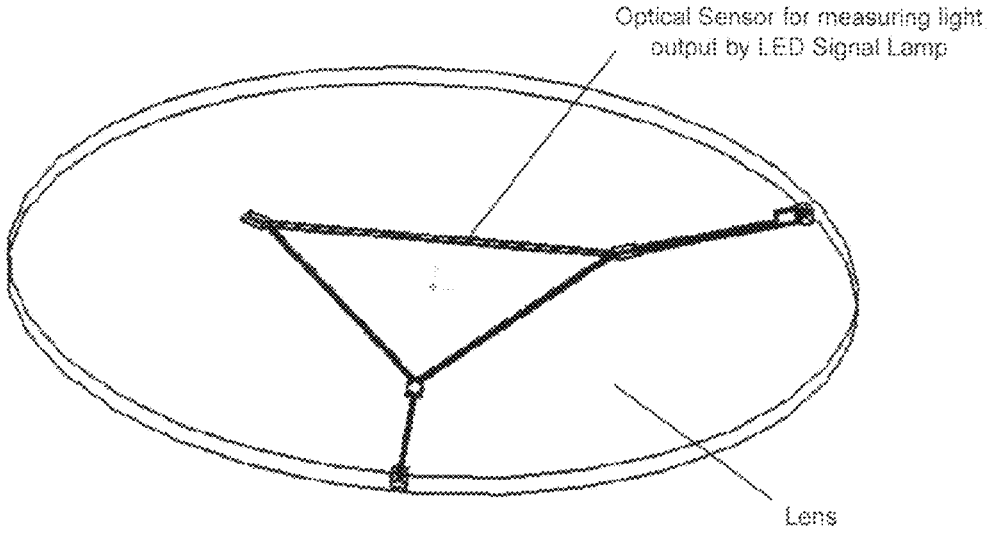
FIG. 20 shows a lens having an optical sensor for measuring light output by an LED signal lamp, in accordance with an embodiment of the present invention.

FIG. 20 shows a lens having an optical sensor for measuring light output by an LED signal lamp, in accordance with an embodiment of the present invention. This sensor allows the light output of the LED signal lamp to be selectively varied in accordance with a feedback loop. For example, it would be possible to dim the light output at nighttime when much less light is necessary to enable drivers to see the signal lamp.

Base

Figure 11:
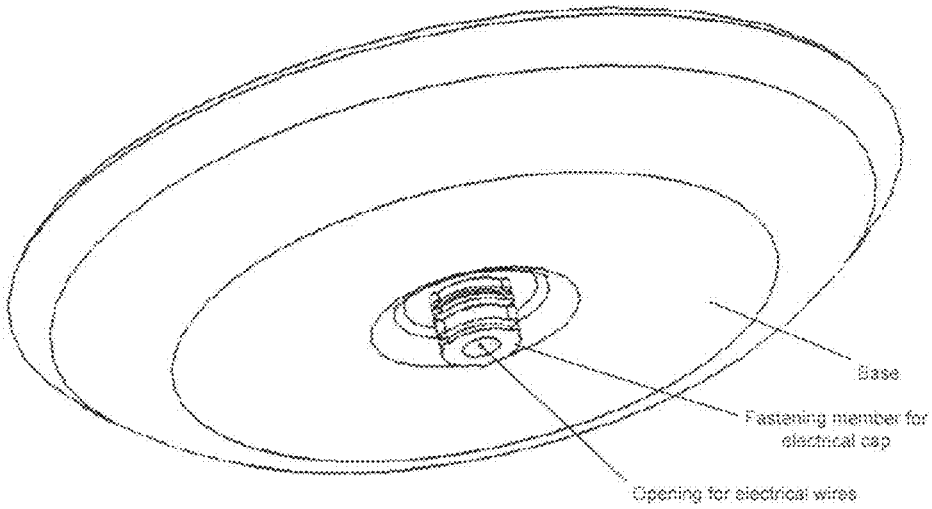
FIGS. 11–13 show a LED signal lamp base, in accordance with an embodiment of the present invention.
Figure 12:
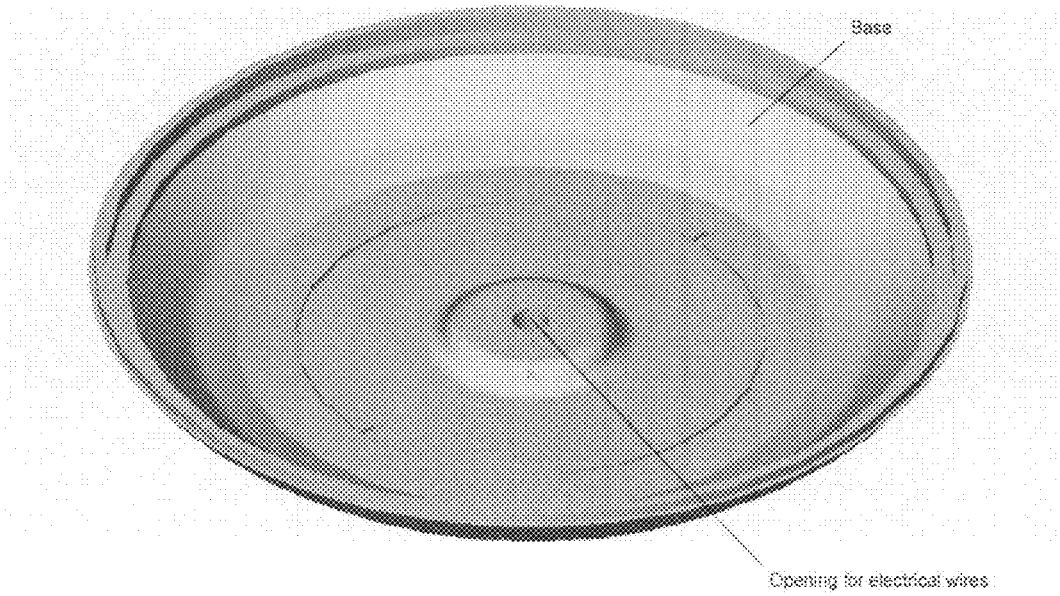
Figure 13:
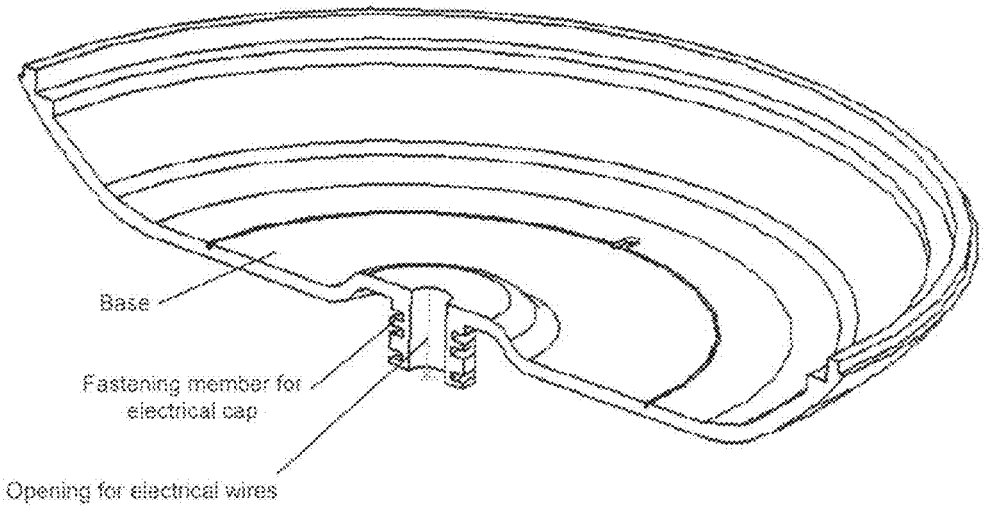
Figure 14:
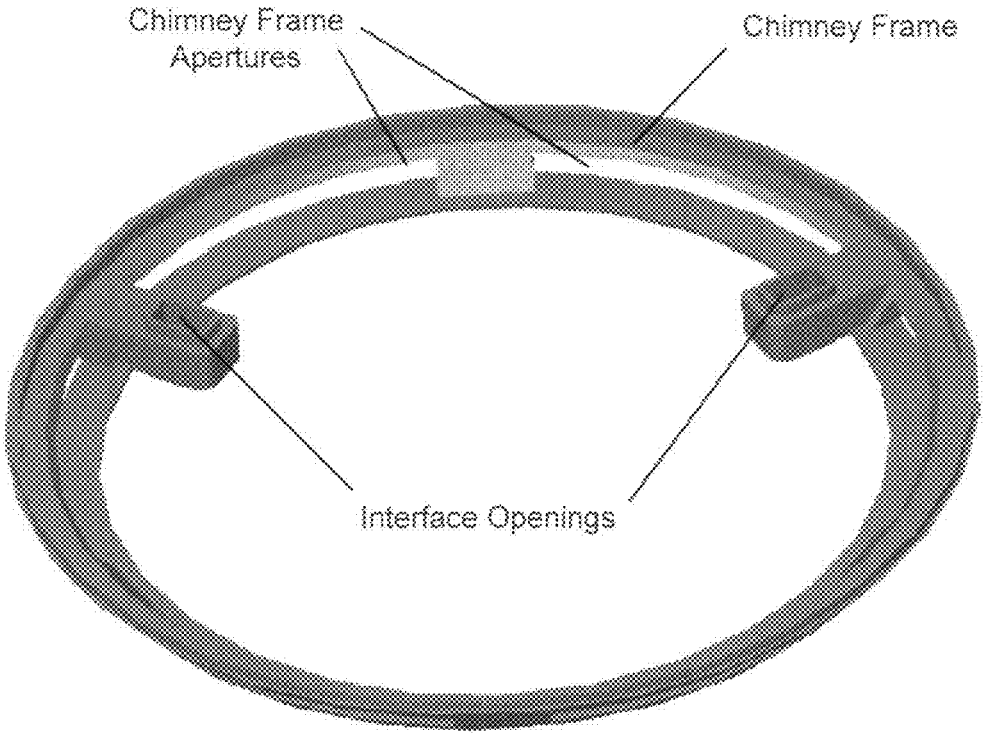
FIGS. 14–19 show a chimney frame, in accordance with an embodiment of the present invention.
Figure 15:
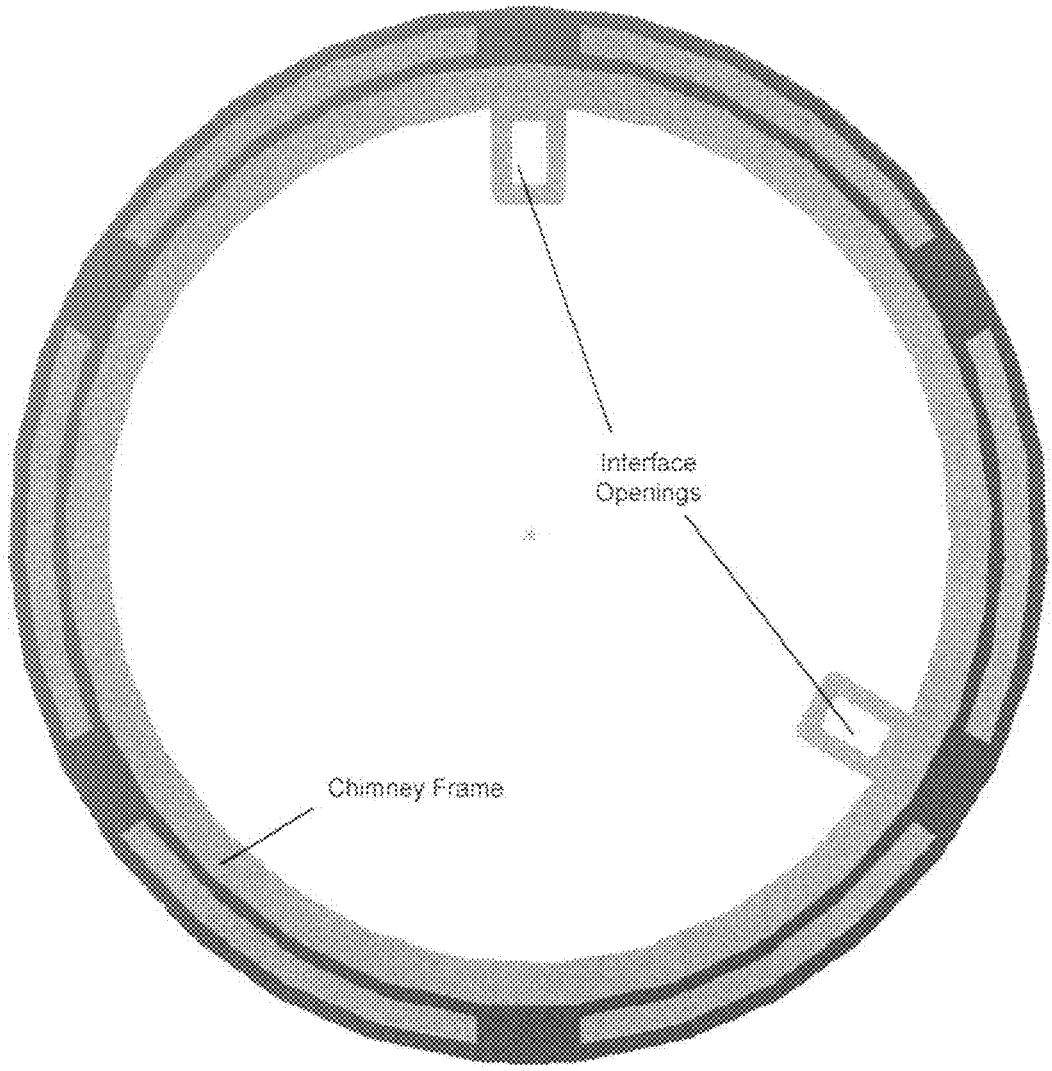
Figure 16:
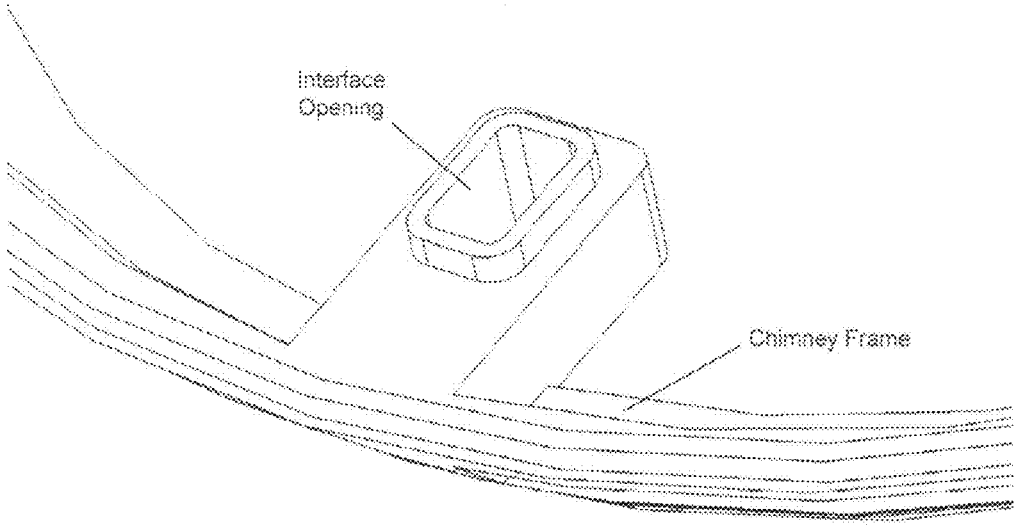
Figure 17:
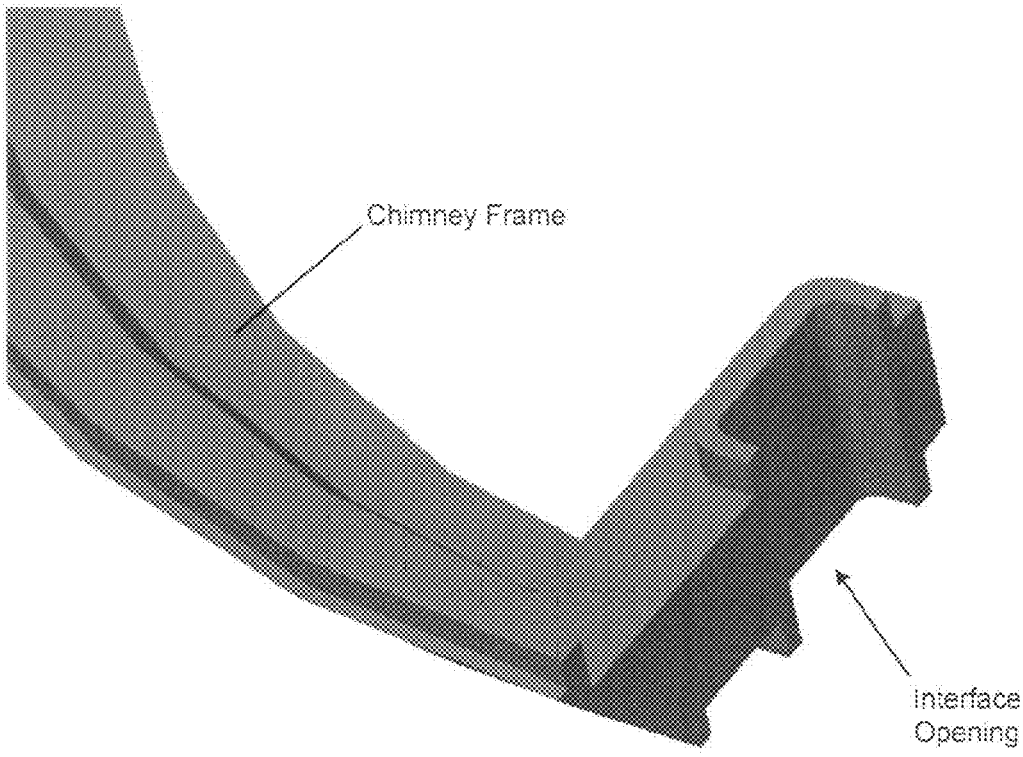
Figure 18:
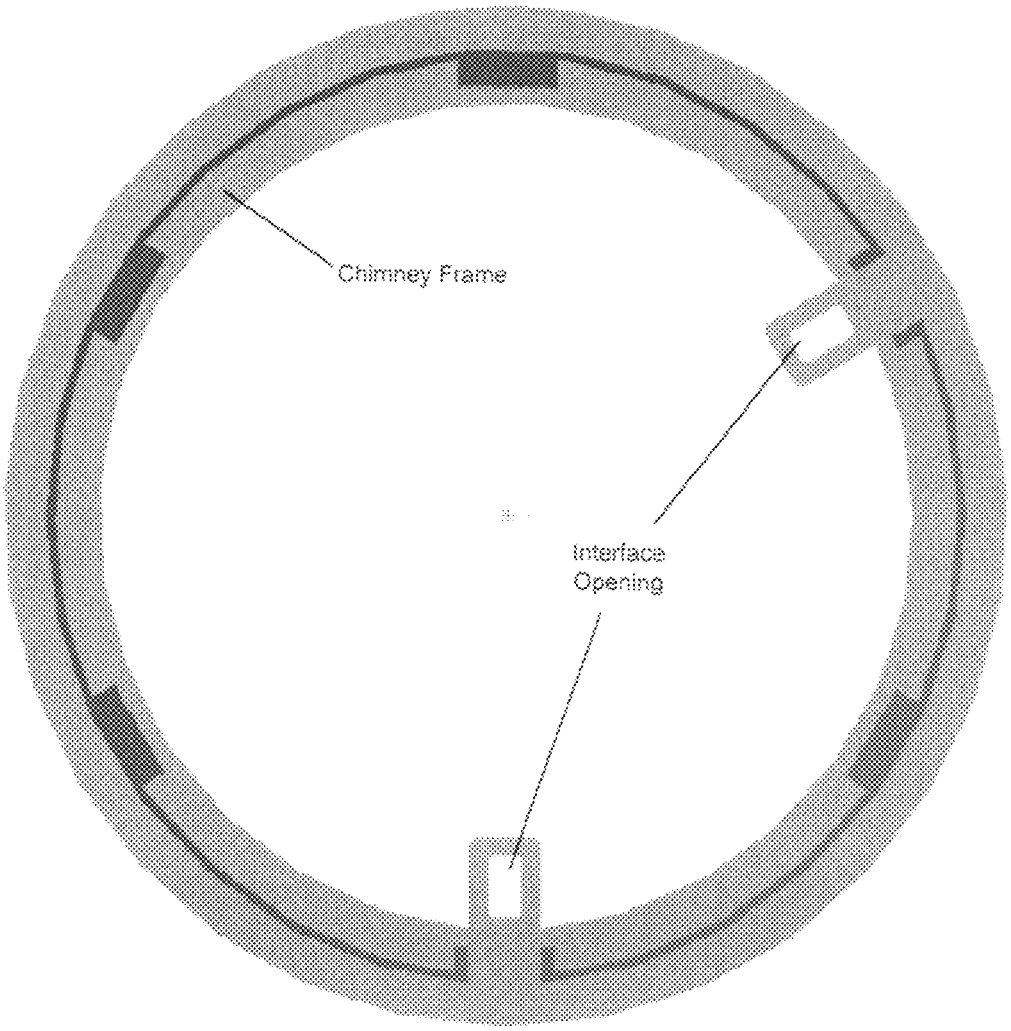
Figure 19:
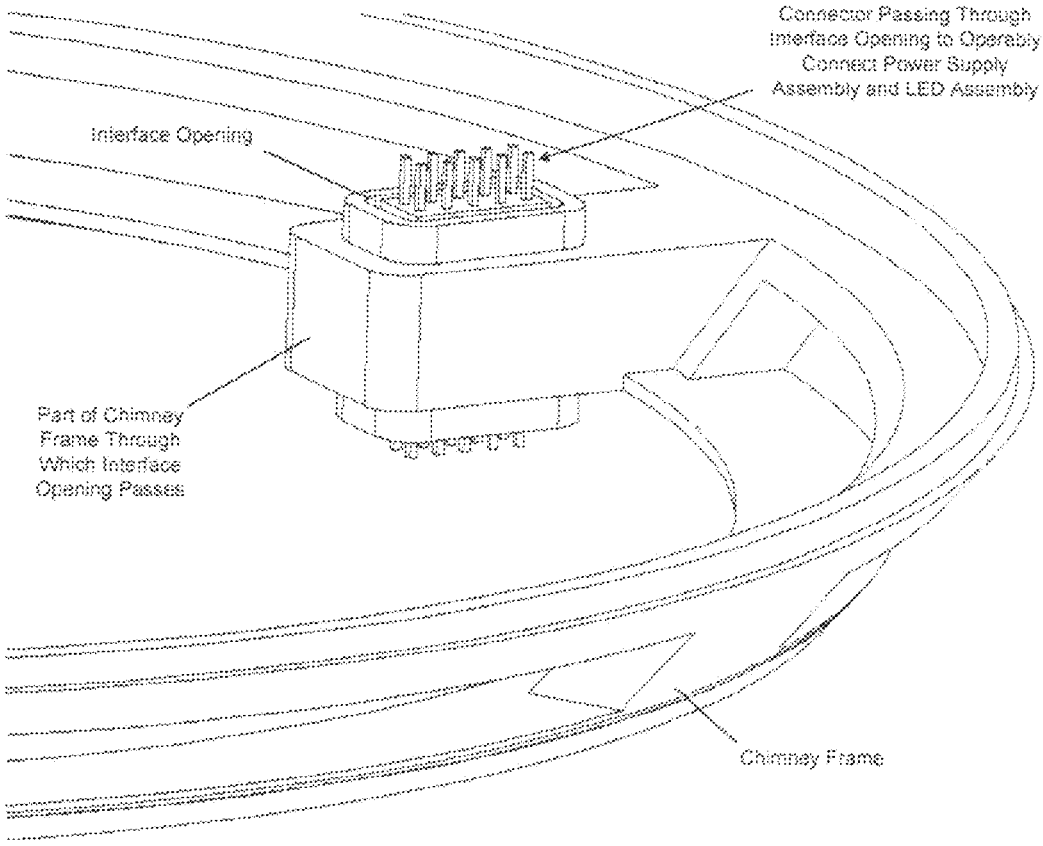

FIGS. 11–13 show a LED signal lamp base, in accordance with an embodiment of the present invention. In the preferred embodiment, the base is adapted to retain an electrical cap for receiving electricity externally.

Traffic Signs

Industry participants have attempted to implement light emitting diode (LED) traffic signs using a completely sealed housing in order to protect the required electronic components from hazardous environmental forces such as humidity and water, as well as various animals, such as birds and snakes.

However, adequate cooling of the electrical components is necessary in order to achieve a high level of reliability and long product life. Therefore, a solution that effectively protects the required electronics from the environment while also effectively cooling the electronics sufficiently to achieve a high level of reliability and long product life will enable successful adoption of LED traffic signs.

FIG. 27 shows a schematic back view and a side view of a light emitting diode (LED) assembly connected to a power supply assembly, in accordance with an embodiment of the present invention.

FIG. 28 shows a schematic perspective view of an LED traffic sign, in accordance with an embodiment of the present invention.

FIG. 29 shows a schematic perspective view of an LED traffic sign opened by approximately 90°, in accordance with an embodiment of the present invention.

Convection Cooling

Implementation of the present invention can simultaneously achieve protection of electronic components, which are sealed within an electronics portion of the housing, while allowing convection cooling of the housing by virtue of its having a ventilated portion that is ventilated to the exterior of the housing. Furthermore, the ventilated portion can be structured as a chimney portion so that a chimney effect can be created to increase the airflow, and thereby increase the convection cooling effect.

Conceptually, this invention can be described as a selectively operable light-emitting signal that has a housing that includes a light emitting diode (LED) assembly and a power supply assembly selectively separated to create a chimney space. The LED assembly includes an LED printed circuit board assembly (PCBA), a plurality of LEDs, and an LED assembly heat sink on the side facing the power supply assembly, thereby defining a first wall of the chimney space. The power supply assembly includes a power supply PCBA and a power supply heat sink on the side facing the LED assembly, thereby defining a second wall of the chimney space, opposite the first wall. The LED assembly heat sink draws heat from the LED PCBA, while the power supply heat sink draws heat from the power supply assembly.

As the heat sinks increase in temperature during operation, a chimney effect is created in the chimney space, causing improved convection cooling than would otherwise occur.

While not required in order to realize the benefits of the present invention, the preferred embodiment includes two power supplies, each powering a separate set of light emitting diodes (LEDs) of the LED assembly. The specific LEDs powered by each power supply are selected so that if only one power supply supplies power, the LEDs powered by that power supply would, by virtue of their configuration in the LED assembly, allow the LED traffic sign to communicate to drivers the intended instructions. For example, each power supply assembly could be electrically connected to support a set of LEDs in a checkerboard pattern, so for every LED, the vertically and horizontally adjacent LEDs (i.e., above, below, right, and left) would be powered by the other power supply.

The selected distance between the LED assembly and the power supply assembly can be achieved by any suitable mechanical means. In FIG. 1 support members are shown to provide the selected spacing to achieve a selectively sized chimney space.

Also, the heat sinks of the LED assembly and power supply assembly are shown to cover a full wall of each. However, each heat sink may be larger or smaller than the assigned wall while still achieving the benefits of the present invention. Similarly, the heat sinks may be of the same or different shape as each other or of the assigned PCBA wall while still achieving the benefits of the present invention.

Housing Ventilation

The chimney effect is improved by the presence of one or more openings toward or at the top of a housing within which the LED and power supply assemblies are housed and one or more openings toward or at the bottom of the housing. Such openings would maintain the interior of the housing (i.e., the immediate fluid environment of the LED and power supply assemblies) in fluid communication with the environment, thereby allowing heated air in the immediate environment of the LED and power supply assemblies to be replaced with cooler air, thereby facilitating the convection cooling effect of the present invention.

Further Embodiments

Figure 43:
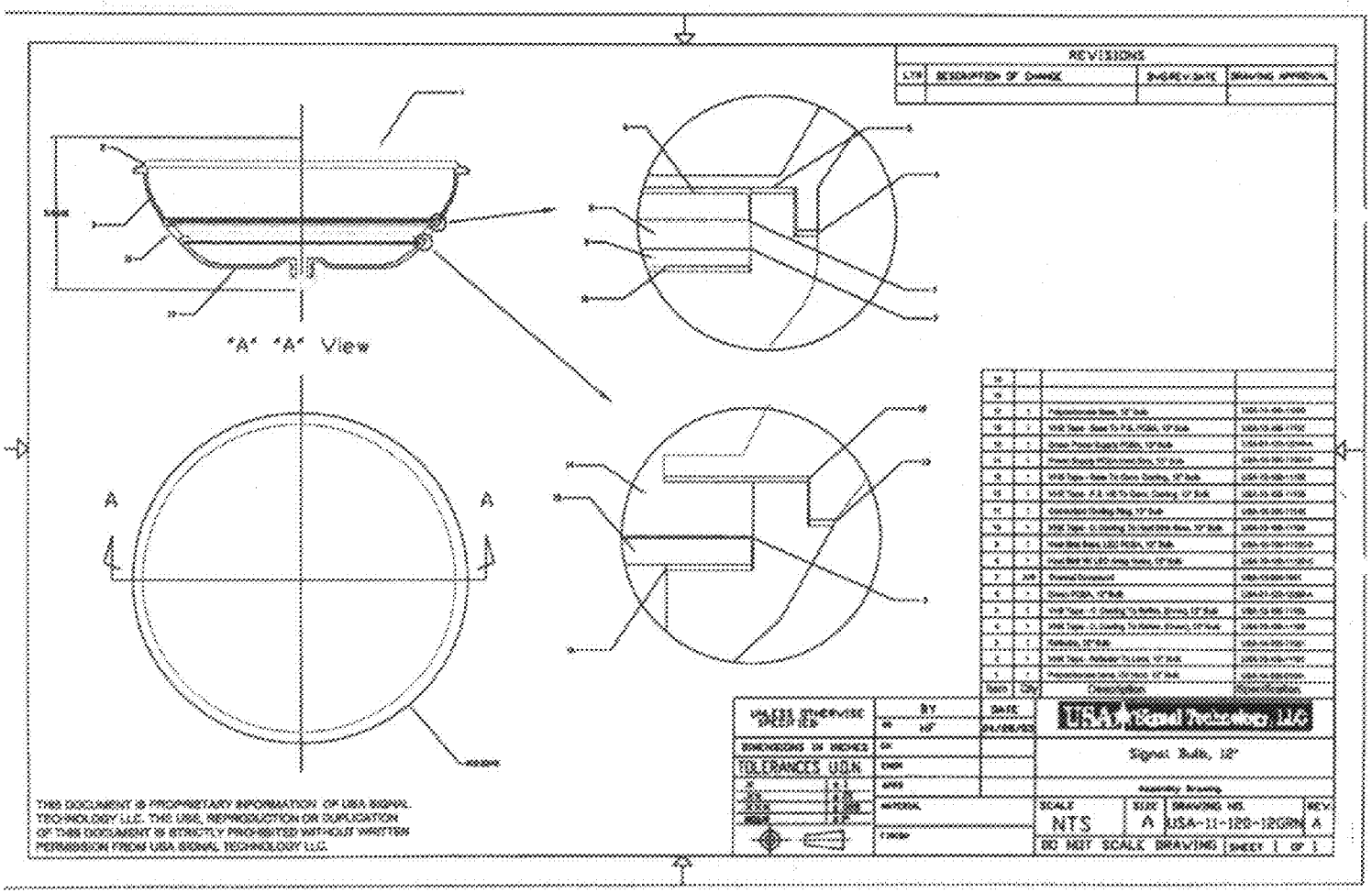
FIGS. 43–45 show a schematic side view of the LED signal lamp, with two regions of connected parts highlighted, in accordance with an embodiment of the present invention.
Figure 44:
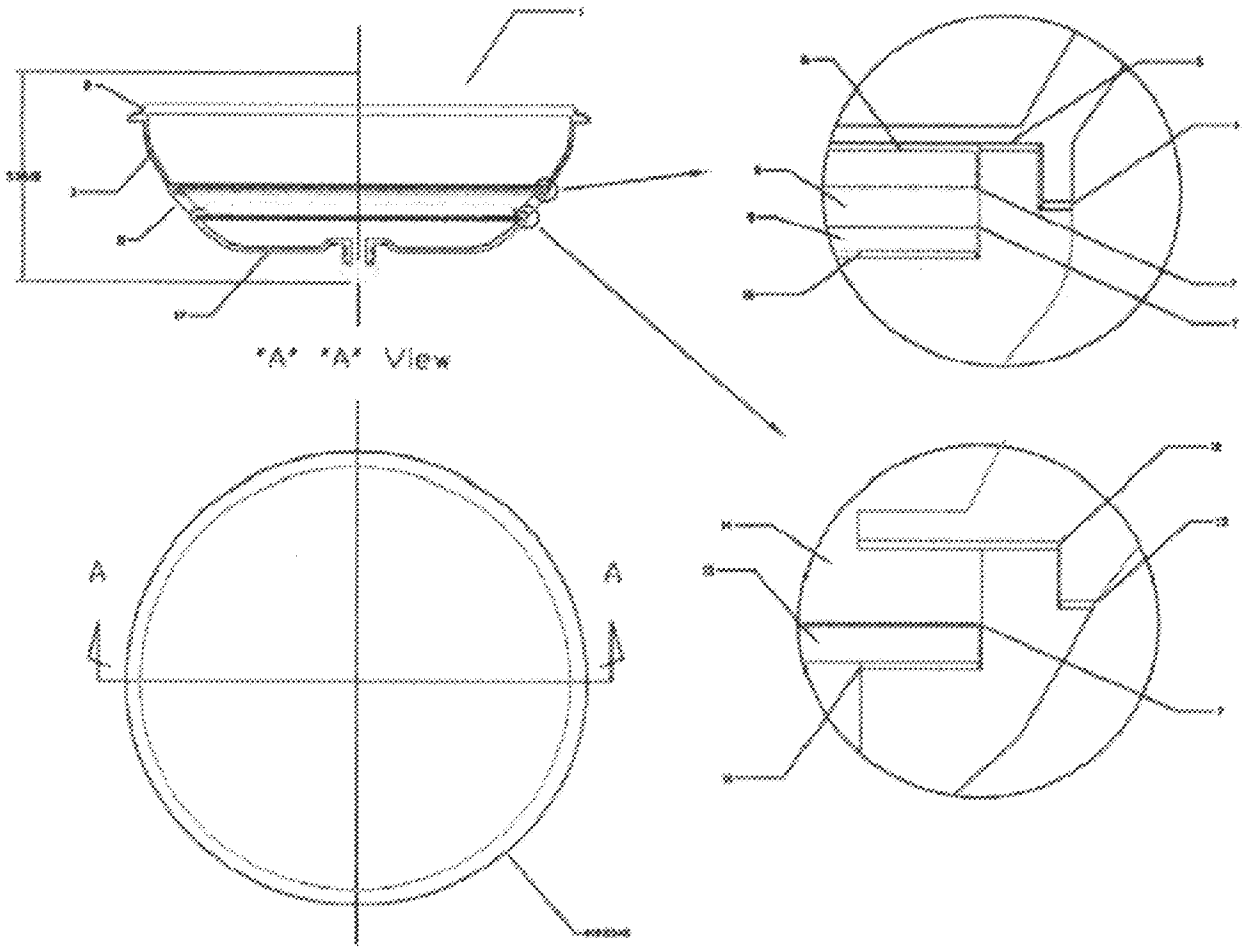
Figure 45:
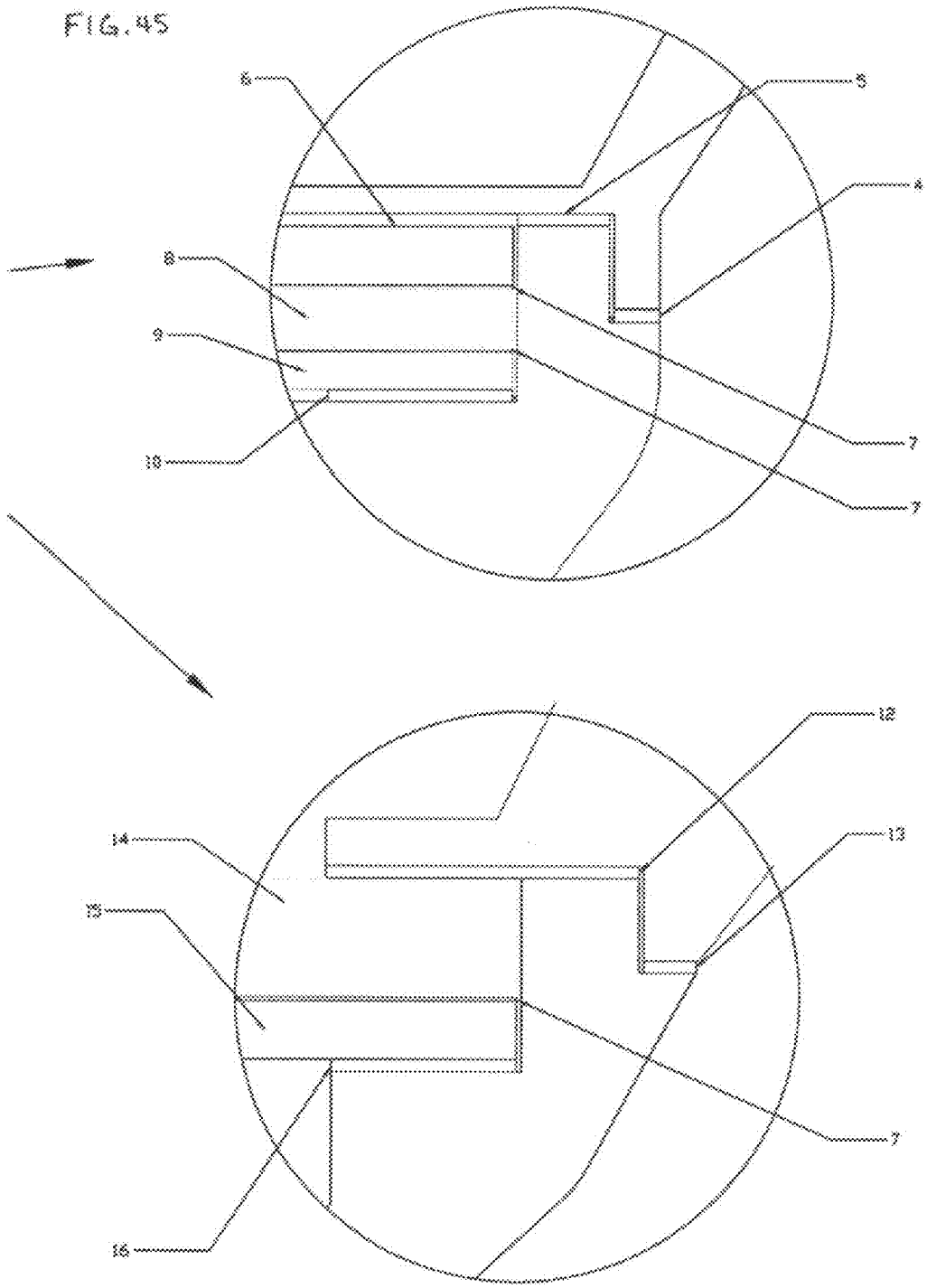

FIGS. 43–45 show a schematic side view of the LED signal lamp, with two regions of connected parts highlighted, in accordance with an embodiment of the present invention.

FIG. 46 shows a parts list of the parts called out in FIGS. 27–29, in accordance with an embodiment of the present invention.

Figure 47:
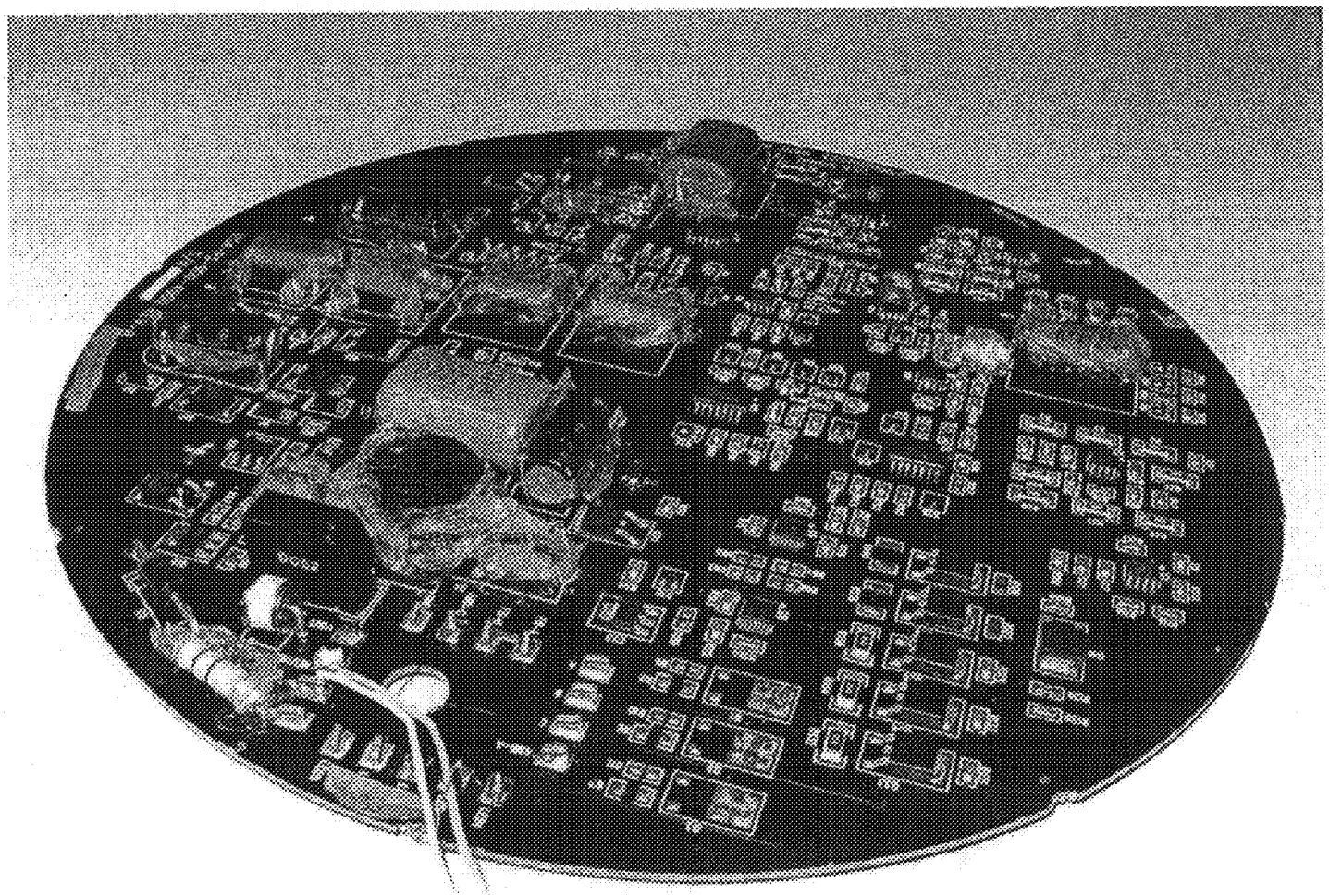
FIG. 47 shows a power supply assembly, in accordance with an embodiment of the present invention.

FIG. 47 shows a power supply assembly, in accordance with an embodiment of the present invention.

Additional Aspects

The present invention also includes several additional aspects, including a tapering aspect, a current bypass aspect, a conflict monitor interface aspect, and a logging aspect.

The tapering aspect includes at least one LED string comprising a plurality of LED stages. Each such stage includes a plurality of LEDs having an intensity. Preferably, the intensity of the LEDs of an LED stage is determined by the number of LEDs in the stage. Among other benefits, the tapering aspect, when implemented within an LED traffic signal lamp, achieves lower power consumption than LED traffic lamps of the prior art having uniform LED intensity. The power savings is achieved because some LEDs of an LED traffic signal lamp may be operated at submaximal intensity without compromising the effectiveness of the lamp. Even more preferably, an LED signal lamp includes a plurality of strings in order to reduce the likelihood of complete failure of the LED signal lamp.

The current bypass aspect of the present invention includes a parallel stage of LEDs connected in parallel to a current bypass module, wherein a constant voltage is maintained across the stage. When one or more LEDs fail, leaving one or more surviving LEDs, the module mitigates the increased current that the surviving LEDs would otherwise have to endure. The surviving LEDs are thereby spared accelerated degradation, reduced reliability, and shortened life.

The conflict monitor interface aspect includes a switch module connected in a ring configuration to a signal lamp and a conflict monitor. The signal lamp is characterized in that it continues to pass current after failure. The conflict monitor is characterized in that it detects signal lamp failure by the cessation of current flow. The switch module solves the interoperability problem by presenting an open switch or great resistance in response to detecting failure of the signal lamp, thereby creating the appearance of a failed signal lamp to the conflict monitor. Preferably, the signal lamp is an LED signal lamp. More preferably, the switch module presents a resistance of 500,000 ohms in response to detecting failure of the LED signal lamp.

The logging aspect of the present invention includes a monitor for detecting the failure of one or more LEDs and determining in which stage each failure occurred, as well as a memory for recording a history of such failures. Preferably, the logging aspect includes a monitor control circuit for estimating the light output level of an LED signal lamp selectively based on the number of LED failures and the distribution of stages in which such failed LEDs reside. More preferably, the memory is implemented as flash memory.

Tapering

A tapering aspect of the present invention is embodied in at least one LED string having a plurality of stages, each stage having intensity. Preferably, the number of LEDs in parallel determines the intensity of each stage in the stage, but those skilled in the art will appreciate that many other implementations of the tapering aspect would be within the spirit and scope of the present invention. The tapering aspect includes an LED signal lamp comprising a plurality of LED arrays. Each LED array includes an intensity level, and each LED of a given LED array is adapted to produce light output at the intensity level of the given LED array. The intensity levels of at least two LED arrays are different.

The tapering aspect achieves reduced power consumption by configuring intensity of LEDs according to visual requirements rather than utilizing a uniform intensity distribution in order to avoid wasting power by providing an unnecessary intensity level in at least some of the LEDs. In the context of a light emitting diode traffic signal lamp, a 2-dimensional Gaussian layout is preferably used for LED intensity to produce a visual effect for viewers roughly corresponding to that of incandescent lighting. In such an implementation, the LEDs closer to the center are brighter than those further from the center in order to more closely mimic the light output distribution of an incandescent traffic signal lamp. This achieves an effective as well as cosmetically pleasing visual effect because drivers are used to seeing the light output distribution of incandescent traffic signal lamps. Unlike LED traffic signal lamps of the prior art that have uniformly distributed LEDs, power is not wasted on LEDs far from the center of the signal lamp.

In addition to the familiarity of drivers with the light output distribution of incandescent traffic signal lamps, another benefit to implementing the tapering aspect is that government traffic light specifications are typically based on light output distribution of incandescent signal lamps. Therefore, an LED traffic signal lamp implementing the tapering aspect could more easily comply with such government traffic light specifications.

Figure 33:
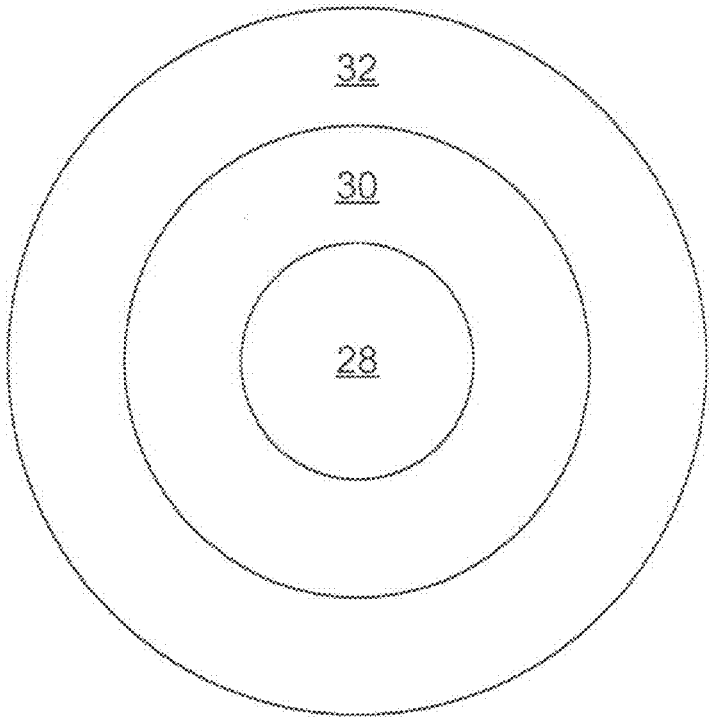
FIG. 33 shows a schematic front view of a signal lamp, schematically showing various stages, in accordance with an embodiment of the present invention.

The schematic depiction in FIG. 33 shows an implementation of the tapering aspect having three LED stages: first stage 28, second stage 30, and third stage 32. The LEDs of each stage could have a different intensity of light output, and those skilled in the art will appreciate the wide variety of possible implementations. In the preferred embodiment, the first stage 28 has a higher intensity than the second stage 30, and the second stage 30 has a higher intensity than the third stage 32. The effect in the preferred embodiment is that the distribution of LED intensities roughly approximates a Gaussian distribution.

Figure 34A:
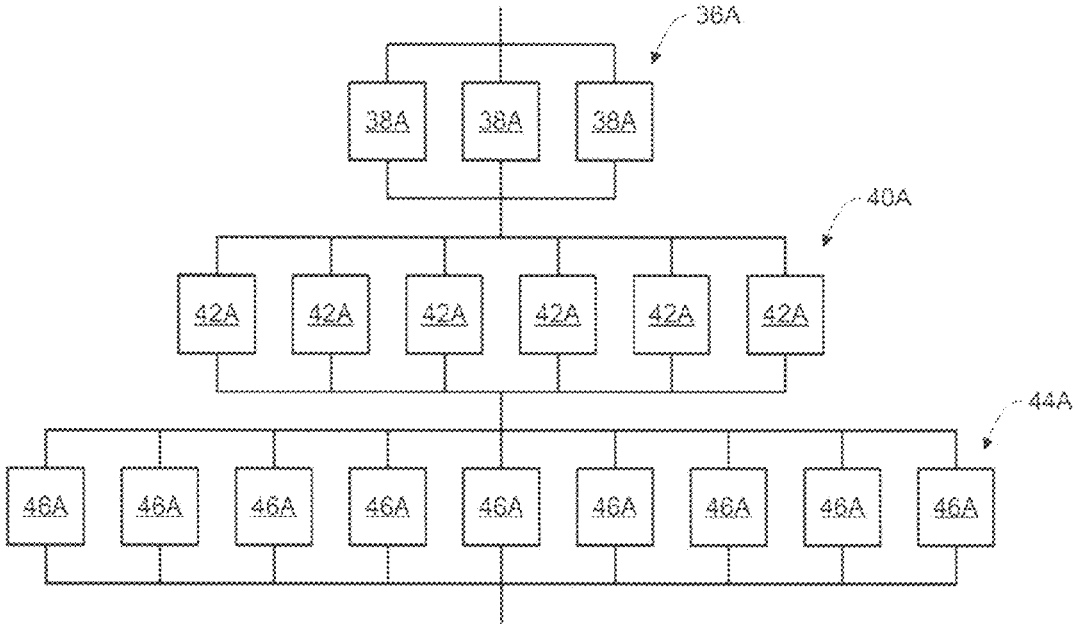
FIGS. 34A and 34B each show a schematic side view of a string of LED stages, each in accordance with an embodiment of the present invention.

FIG. 34A shows a schematic representation of a string 34A having three LED stages. A first stage 36A includes three LEDs 38A, a second stage 40A includes six LEDs 42A, and a third stage 44A includes nine LEDs 46A. The effect of this distribution is that the LEDs 38A have greater intensity than the LEDs 42A, and the LEDs 42A have greater intensity than the LEDs 46A.

Figure 34B:
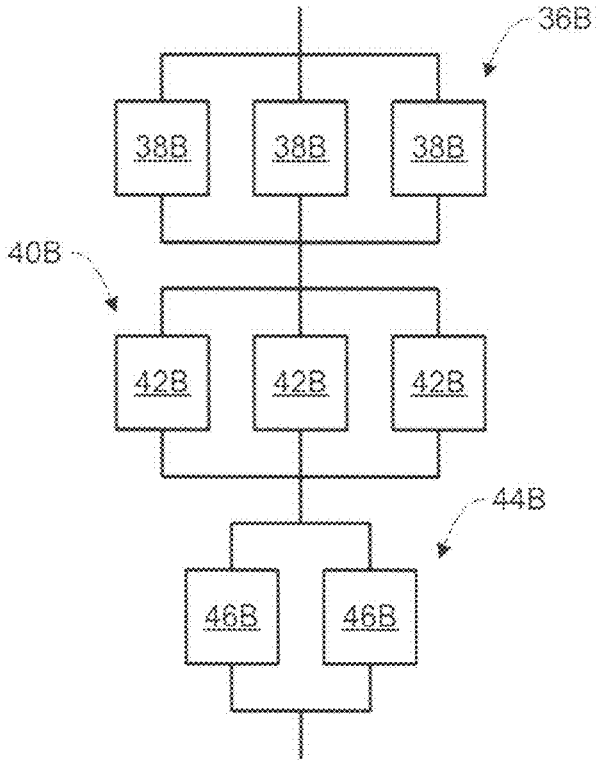
Figure 35:
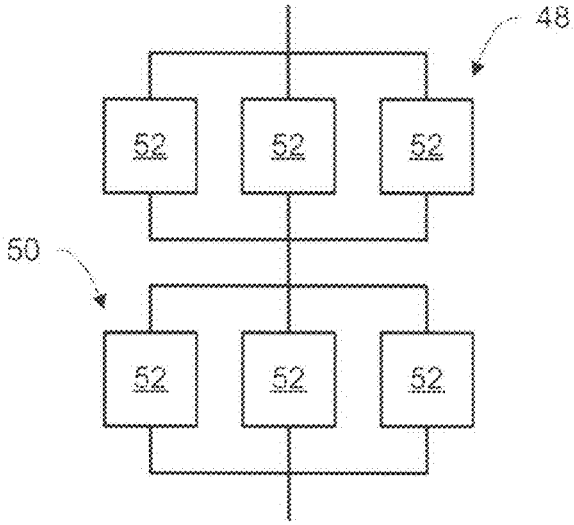
FIG. 35 (PRIOR ART)
FIG. 35 shows a schematic side view of a string of LED stages of the prior art.

Similar to FIG. 34A, FIG. 34B shows another schematic representation of a string 34B having three LED stages. A first stage 36B includes two parallel sets of three LEDs 38B, a second stage 40B includes one set of three LEDs 42B, and a third stage 44B includes one set of two LEDs 46B. In this embodiment, the LEDs 38B have the same intensity as the LEDs 42B, and the LEDs 46B have greater intensity than LEDs 38B and LEDs 42B.

The preferred embodiment includes a plurality of strings, each string having a plurality of stages. This configuration reduces the risk of the entire signal lamp failing by allowing for the possibility that one or more strings can fail while leaving one or more strings functional. This reduces the risk that drivers will be seriously endangered due to complete failure of a signal lamp.

Current Bypass

The current bypass module of the present invention solves a continuing problem of LEDs. When LEDs are arranged in a parallel stage with a constant voltage across the stage and one or more LEDs fail, leaving one or more LEDs surviving, the surviving LEDs will be forced to endure a greater current load. As a result of the increased current load, the surviving LEDs suffer accelerated degradation, reducing their reliability and shortening their functional lives.

The present invention provides a current bypass module connected in parallel with a stage of LEDs. When one or more of the LEDs fail, the current bypass module assumes a corresponding current load, sparing the remaining LEDs in the stage from the accelerated degradation, reduced reliability, and shortened functional lives that would otherwise result from enduring a correspondingly increased current load.

Figure 36:
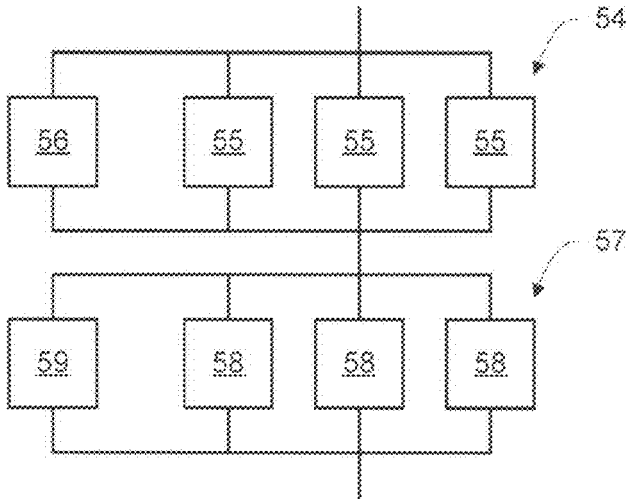
FIG. 36 shows a schematic side view of a string of LED stages, in accordance with an embodiment of the present invention.

An schematically depicted embodiment of the current bypass module is depicted in FIG. 36. A first stage 54 includes LEDs 55 connected in parallel with current bypass module 56. Similarly, a second stage 57 includes LEDs 58 connected in parallel with current bypass module 59.

Figure 37:
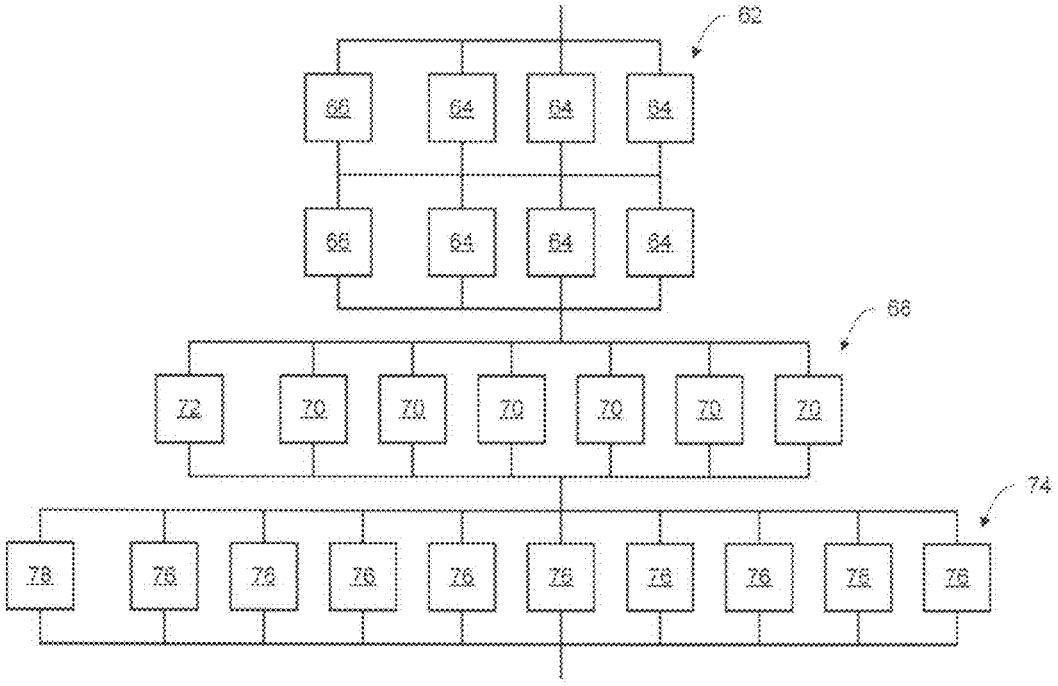
FIG. 37 shows a schematic side view of a string of LED stages, in accordance with an embodiment of the present invention.
Figure 38:
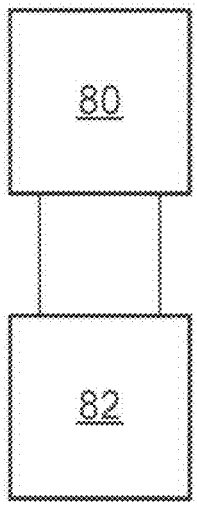
FIG. 38 (PRIOR ART)
FIG. 38 shows a schematic block diagram of an incandescent signal lamp connected to a conflict monitor of the prior art.
Figure 39:
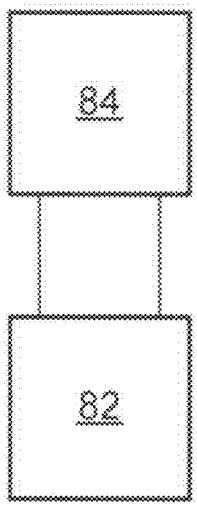
FIG. 39 (PRIOR ART)
FIG. 39 shows a block diagram of a light emitting diode signal lamp connected to a conflict monitor of the prior art.

Another embodiment of the current bypass module is shown schematically in FIG. 37. A first stage 62 includes two sets of parallel LEDs 64, each set being connected in parallel with a current bypass 66. A second stage 68 includes LEDs 70 connected in parallel to current bypass module 72. A third stage includes LEDs 76 connected in parallel to current bypass 78.

While those skilled in the art will appreciate that there are many ways to implement current bypass modules 66, 72, and 78 within the spirit and scope of the current bypass aspect of the current invention, the preferred embodiment implements the current bypass modules 66, 72, and 78 as zener diodes.

Conflict Monitor Interface

A conflict monitor interface aspect of the present invention provides an interface with a conflict monitor of the prior art for an LED signal lamp in order that a failed LED signal lamp appears to the conflict monitor the same as a failed incandescent signal lamp. Examples of reasons for an LED signal lamp being considered to have failed include a power supply failure, LEDs aging to an extent that their light output does not meet the desired light output, and LED failures having reduced light output to an extent that the light output does not meet the desired light output.

Figure 40:
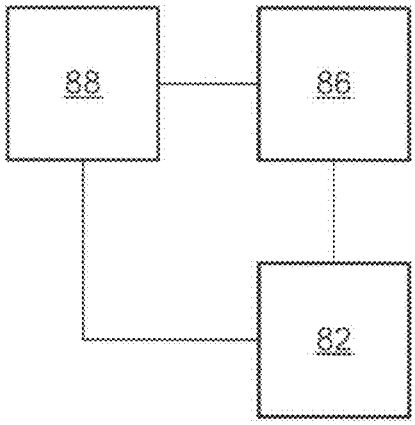
FIG. 40 shows a block diagram of light emitting diode signal lamp connected to a conflict monitor, in accordance with an embodiment of the present invention.

FIG. 40 depicts a block diagram of an implementation of the conflict monitor interface: a conflict monitor 82 operatively connected in a ring configuration to an LED signal lamp 86 and a switch module 88. Upon failure of the LED signal lamp 86, the switch module 88 is adapted to cause the conflict monitor 82 to perceive that LED signal lamp 86 has failed.

Figure 41:
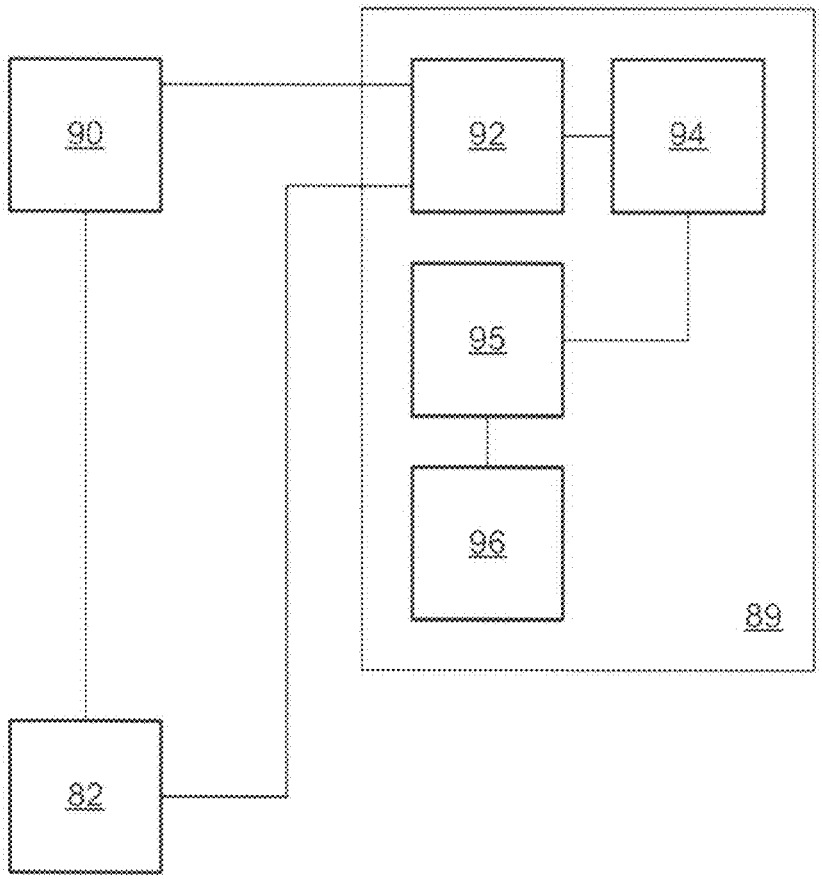
FIG. 41 shows a block diagram of light emitting diode signal lamp connected to a conflict monitor, in accordance with an embodiment of the present invention.

A more detailed block diagram of the preferred embodiment of the conflict monitor interface is shown in FIG. 41. Conflict monitor 82 is connected in a ring configuration to the LED signal lamp 89 and a resetable latching relay 90. The LED signal lamp 89 includes a power supply 92, LEDs 94, a monitor 95, and a monitor control circuit 96.

The latching relay 90 is preferably a form 2A-latching relay in input stage. The relay 90 is normally closed to allow current flow to LED signal lamp 89. When a self kill operation is performed, the relay 90 is opened, causing power to the LED bulb to be cut in order to require a service person to manually reset the LED signal lamp 89 for normal operation to be resumed.

A table showing conditions under which the signal lamp 89 will utilize the latching relay 90 to perform a self kill operation, killing power to the LED signal lamp 89.

| | >60 VAC | >80 VAC | Power Supply On | LED light output > 60% |
|---|---|---|---|---|
| Don't care | 1 | 0 | 0 | 0 |
| Impossible | 1 | 0 | 0 | 1 |
| Self kill | 1 | 0 | 1 | 0 |
| Normal | 1 | 0 | 1 | 1 |
| Self kill | 1 | 1 | 0 | 0 |
| Impossible | 1 | 1 | 0 | 1 |
| Self kill | 1 | 1 | 1 | 0 |
| Normal | 1 | 1 | 1 | 1 |

The preferred embodiment of the conflict monitor interface implements a resetable latching relay 90 comprising a presentation of "open" as 500,000 ohms to indicate a state equivalent to the conflict monitor 82 to a burned out incandescent signal lamp.

The power supply 92 is operatively connected to LEDs 94 suitably to provide power to operate the LEDs 94. The monitor 95 is operatively connected to the LEDs 94 suitably to detect current fluctuations in order to recognize the failure of one or more of LEDs 94. The monitor control circuit 96 is operatively connected to the monitor 95 in order to control operation of the monitor 95 and in order to determine when signal lamp 89 should be considered to have failed. The monitor control circuit is also operatively connected to the resetable latching relay 90 in order to perform a timely self kill operation by opening the relay 90 in response to reaching a determination that the signal lamp 89 should be considered to have failed.

Logging

A logging aspect of the present invention can be implemented with a memory module in which LED failures are logged in order to determine whether the estimated LED signal lamp light output is likely to have fallen below a desired level. An example of a desired light output level is that signal lamp specifications of the State of California require that light output level remain at or above 60% of initial light output level. Should the estimated light output level of the LED signal lamp fall below 60%, the signal lamp would no longer meet the signal lamp specifications of the State of California.

Figure 42:
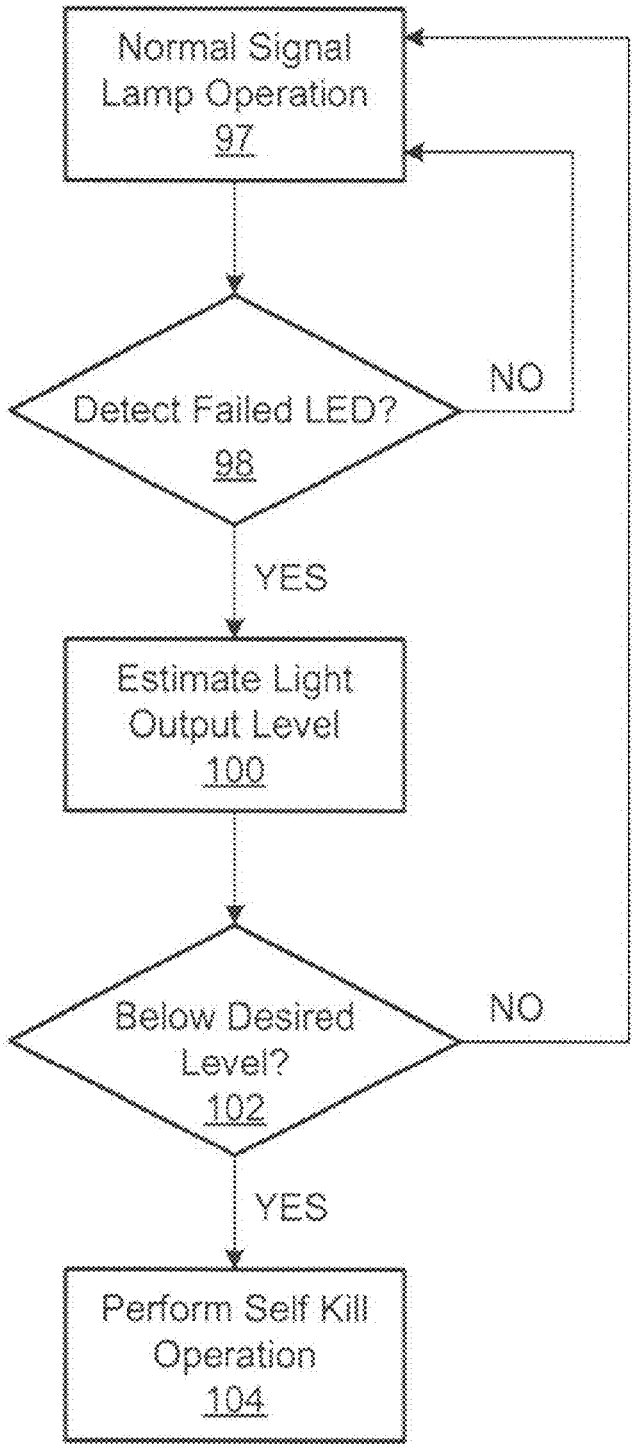
FIG. 42 shows a flowchart of a timely performing a self kill operation, in accordance with an embodiment of the present invention.

Turning to FIG. 42, a flowchart illustrates the preferred embodiment of the logging aspect. Consider operation of the signal lamp, beginning with normal operation (step 96). So long as an LED failure is not detected (step 98), the signal lamp will operate normally (step 96).

When an LED failure is detected (step 98), a determination is made to estimate the light output level of the signal lamp following the LED failure (step 100). If the estimated light output level remains at or above a desired level (step 102), then the signal lamp will continue to operate normally (step 96). However, if the estimated light output level falls below a desired level (step 102), the signal lamp will perform a self kill operation (step 104).

The self kill operation can include or be linked to the communication of status information to an associated conflict monitor indicating that the signal lamp is not operating normally, has failed, or has performed a self kill operation.

The logging system for indirect determination of dimming can include logic for detecting failures by voltage fluctuation and identifying the stage in which the failed LED resides by the magnitude of the fluctuation.

For example, consider an embodiment that implements a 2.5V constant across string. A failure of an LED in stage 1, which has 3 LEDs in parallel, causes about a 10 mV fluctuation. A failure of an LED in stage 2, which has 6 LEDs in parallel, causes about a 5 mV fluctuation. A failure of an LED in stage 3, which has 9 LEDs in parallel, causes about a 3 and ⅓ mV fluctuation.

While it will be appreciated by those skilled in the art that the memory can be implemented in many ways without going beyond the spirit and scope of the present invention, the preferred memory for storing history includes a flash memory.

The logic for determining the degree of dimming based on history can be implemented in many different ways. For example, the logic can be based only on failures, assuming constant LED brightness. The logic can be based on failures and assumed brightness degradation during LED lifetime at a selected constant age, for convenience. The logic can be based on age-based brightness degradation and failures.

The monitor control circuit 93 of FIG. 41 can be adapted to include the memory for storing history.

In the preferred embodiment of the present invention, LED signal lamp has a microprocessor controlled programmable power supply, A/D converter, and photodetector utilized to enable the LED signal lamp to meet the requirements of changing environmental lighting conditions.

Six (6) sheets of schematic drawings are included in Appendix 3 to further enable the making and selling of certain embodiments of the present invention by those skilled in the art.

Terminology

The use of the terms "a" and "an" and "the" and similar referents in the context of describing embodiments of the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention, and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A convection cooled traffic control device for selectively indicating traffic control guidance to vehicles, the device comprising:

a power supply and controller assembly having a heat sink panel on one side;

an LED assembly having a heat sink panel on one side;

a chimney frame connecting the power supply assembly to the LED assembly with the heat sink panels of the assemblies facing each other at a selected distance, thereby creating a chimney space between the heat sinks, configured to create a chimney effect when the power supply and the LED assembly are dissipating heat, wherein the chimney area is substantially vertical; and wherein the power supply and controller assembly and the LED assembly are sealed as a single space separate from the chimney space; and wherein the chimney frame includes one or more interface openings which maintain the chimney space in fluid communication with chimney frame's environment.

2. The convection cooled traffic control device of claim 1, further comprising:

a housing enclosing the assemblies and frame, wherein the housing includes at least one top opening and at least one bottom opening; and wherein the effectiveness of the chimney space is enhanced by being in fluid communication with the traffic control device's environment.

3. An enhanced brightness traffic control device for selectively displaying patterns of light emitting diodes (LEDs), the device comprising:

an LED assembly including a plurality of LEDs;

a reflector array including a plurality of subcells, wherein each subcell includes a reflective wall that defines an opening;

wherein each said subcell is associated with an LED which protrudes through the associated opening;

wherein the reflective wall of each subcell is configured to enhance the directionality of LED light output, thereby enhancing the brightness of light output by the traffic control device.

4. The enhanced brightness traffic control device of claim 3, wherein the reflector array includes a plurality of cells; and wherein each cell includes three subcells.

5. A convection cooled traffic control device for selectively directing traffic by selectively actuating patterns of light emitting diodes (LEDs), the traffic control device comprising:

a housing having a perimeter wall;

an LED assembly oriented within the perimeter wall and configured to selectively actuate such patterns of LEDS in order to selectively direct traffic, wherein the LED assembly produces heat as a byproduct of normal operation;

a power supply assembly oriented within the perimeter wall and wherein the power supply assembly produces heat as a byproduct of normal operation; and wherein the LED assembly and the power supply assembly are selectively relatively oriented to create a chimney space between the assemblies, wherein the LED assembly comprises a first wall of the chimney space, and wherein the power supply assembly comprises a second wall of the chimney space.

6. The convection cooled traffic control device of claim 5, wherein the LED assembly further comprises:

an LED printed circuit board assembly (PCBA);

a plurality of LEDs connected to the LED PCBA;

an LED assembly heat sink connected to the LED PCBA in order to draw heat from the LED PCBA; and wherein the LED assembly heat sink comprises the first wall of the chimney space.

7. The convection cooled traffic control device of claim 5, wherein the power supply assembly further comprises:

a power supply PCBA;

a power supply heat sink connected to the power supply PCBA in order to draw heat from the power supply PCBA; and wherein the power supply heat sink comprises the second wall of the chimney space.

8. The convection cooled traffic control device of claim 5, wherein the perimeter wall of the housing defines:

a top opening for maintaining the housing's interior in fluid communication with the housing's environment;

a bottom opening in fluid communication with the top opening for maintaining the housing's interior in fluid communication with the housing's environment;

whereby if the heat sinks' temperatures exceed the environment's temperature, a chimney effect is created which causes airflow entering the housing's interior through the bottom opening and exiting the housing's interior through the top opening, thereby creating an increased convection cooling effect within the housing's interior.

9. A tapering system of a light emitting diode (LED) traffic control device, comprising:

at least one LED string;

wherein each LED string includes a plurality of stages;

wherein at least one of the plurality of stages includes a plurality of LEDs configured in parallel;

wherein each stage includes at least one LED; and wherein each stage includes an intensity;

wherein the number of LEDs in the plurality of LEDs configured in parallel determines the brightness of each LED of the plurality of LEDs configured in parallel.

10. The tapering system of claim 9, wherein the tapering system's power consumption is selectively set by configuring the intensities non-uniformly.

11. The tapering system of claim 9, further comprising:

an LED display area within which the LEDs are arranged for visual presentation to drivers whose behavior is to be regulated by the LED traffic control device;

wherein the intensities are selected according to a 2-dimensional Gaussian pattern, whereby power consumption of LED's farther from the center of the LED display area are selectively lower.

12. The tapering system of claim 9, wherein each of the plurality of stages further comprises:

a current bypass module connected in parallel with the LEDs of the stage;

wherein the current bypass module is configured to, upon failure of one of the LEDs of the stage, assume a current load corresponding to the failed LED, thereby sparing the remaining LEDs in the stage from accelerated degradation, reduced reliability, and shortened functional lives that would otherwise result from enduring a correspondingly increased current load.

13. The tapering system of claim 12, wherein the each said current bypass module comprises at least one zener diode.

14. A brightness regulated light emitting diode (LED) traffic signal lamp comprising:

an LED signal lamp, comprising:

a plurality of LED arrays;

wherein each LED array includes an intensity level;

wherein each LED of each of the plurality of LED arrays is adapted to produce light output at the intensity level of the corresponding LED array;

wherein the tapering system's power consumption is selectively set by configuring the intensities non-uniformly.

15. The brightness regulated LED traffic signal lamp of claim 14, further comprising:

an LED display area within which the LEDs are arranged for visual presentation to drivers whose behavior is to be regulated by the LED traffic signal lamp;

wherein the intensities are selected according to a 2-dimensional Gaussian pattern, whereby power consumption of LED's farther from the center of the LED display area are selectively lower.

16. A conflict monitor interface system for a light emitting diode (LED) signal lamp, comprising:

an LED traffic signal lamp;

a conflict monitor adapted to provide a conflict signal in response to detecting failure of an incandescent traffic signal lamp;

an interface circuit operably coupled to the LED traffic signal lamp and to the conflict monitor; and wherein the interface circuit detects failure of the LED traffic signal lamp and presents what appears to the conflict monitor as open circuit thereby mimicking a failed incandescent bulb.

17. The conflict monitor interface system of claim 16, wherein the interface circuit further comprises:

a resetable latching relay;

wherein the interface circuit comprises a ring connection between the LED traffic signal lamp, the conflict monitor, and the resetable latching relay; and wherein the interface circuit is adapted to present an essentially open circuit to the conflict monitor by opening the resetable latching relay.

18. The conflict monitor interface system of claim 16, wherein the interface circuit is configured to present an essentially open circuit to the conflict monitor by presenting a resistance of approximately 500,000 ohms.

19. The conflict monitor interface system of claim 16, wherein the interface circuit is configured to cut power to the LED traffic signal lamp upon detecting failure of the LED traffic signal lamp.

20. A failure logging method for compiling light emitting diode (LED) failures within an LED traffic signal light, the method comprising the steps of:

detecting failure of an LED of the LED traffic signal light;

determining the light output of the LED traffic signal light following failure of an LED;

if the determined light output level is below a desired light output level, performing a self-kill operation by the LED traffic signal light.

21. The failure logging method of claim 20, further comprising the step of:

if the determined light output level is below a desired light output level, providing status information to a conflict monitor.

22. The failure logging method of claim 20, wherein the step of determining the light output of the LED traffic signal light following failure of an LED comprises the step of:

determining the light output of the LED traffic signal light following failure of an LED based on monitoring voltage fluctuations and determining the former brightness of the failed LED by the magnitude of the voltage fluctuation.

23. The failure logging method of claim 20, wherein the step of determining the light output of the LED traffic signal light following failure of an LED comprises the step of:

determining the light output of the LED traffic signal light following failure of an LED based on an assumption of constant LED brightness over time.

24. The failure logging method of claim 20, wherein the step of determining the light output of the LED traffic signal light following failure of an LED comprises the step of:

determining the light output of the LED traffic signal light following failure of an LED based on prior LED failures and an assumption of brightness degradation during LED lifetime at a selected constant age.

25. The failure logging method of claim 20, wherein the step of determining the light output of the LED traffic signal light following failure of an LED comprises the step of:

determining the light output of the LED traffic signal light following failure of an LED based on prior failures and a model of age-based brightness degradation not based on a constant age assumption.

26. The failure logging method of claim 20, further comprising the step of:

recording in a computer-readable medium failure data representing the failure of the LED of the LED traffic signal light.

* * * * *